US009966215B2

(12) United States Patent
Bang et al.

(10) Patent No.: US 9,966,215 B2
(45) Date of Patent: May 8, 2018

(54) PERMANENT MAGNET OPERATING DEVICE

(71) Applicant: ENTEC ELECTRIC AND ELECTRONIC CO., LTD., Gyeonggi-do (KR)

(72) Inventors: Young Bong Bang, Seoul (KR); Chang Hyuk Lee, Seoul (KR); Ji Won Choi, Gyeonggi-do (KR); Young Il Kim, Gyeonggi-do (KR); Heung Ryeol Koh, Gyeonggi-do (KR); Myeong Seob Choi, Gyeonggi-do (KR)

(73) Assignee: Entec Electric and Electronic Co., Ltd., Hwaseong (KR)

( * ) Notice: Subject to any disclaimer, the term of this patent is extended or adjusted under 35 U.S.C. 154(b) by 197 days.

(21) Appl. No.: 14/888,071

(22) PCT Filed: May 24, 2013

(86) PCT No.: PCT/KR2013/004569
§ 371 (c)(1),
(2) Date: Oct. 29, 2015

(87) PCT Pub. No.: WO2014/178470
PCT Pub. Date: Nov. 6, 2014

(65) Prior Publication Data

US 2016/0086756 A1 Mar. 24, 2016

(30) Foreign Application Priority Data

Apr. 30, 2013 (KR) ..... 10-2013-0048591

(51) Int. Cl.
*H01H 47/00* (2006.01)
*H01H 51/22* (2006.01)
(Continued)

(52) U.S. Cl.
CPC ..... *H01H 51/2209* (2013.01); *H01F 7/1615* (2013.01); *H01H 47/22* (2013.01);
(Continued)

(58) Field of Classification Search
CPC ..... H01H 51/2209
(Continued)

(56) References Cited

U.S. PATENT DOCUMENTS 4,814,732 A * 3/1989 Pratt ..... H01F 7/1646 335/230
5,896,076 A * 4/1999 van Namen ..... H01F 7/1615 335/222
(Continued)

FOREIGN PATENT DOCUMENTS

JP 2006004902 A 1/2006
JP 2007027370 A 2/2007
(Continued)

*Primary Examiner* — Stephen W Jackson
(74) *Attorney, Agent, or Firm* — TIPS Group

(57) ABSTRACT

The disclosure relates to a permanent magnet actuator comprising: a stator iron core having a space therein-side, and having a first wall and a second wall opposing the first wall; a movable element moving reciprocally between the first wall and the second wall, along a moving axis which connects the first wall and the second wall inside the space; a first magnetomotive force supplying body and a second magnetomotive force supplying body disposed respectively on the first wall and the second wall, so as to supply a magnetomotive force to the movable element for the reciprocal movement thereof, wherein, at least one of the first magnetomotive force supplying body and the second magnetomotive force supplying body selectively produces a bidirectional magnetomotive force; a permanent magnet disposed between the first magnetomotive force supplying body and the second magnetomotive force supplying body, and providing a coercive force to the movable element for
(Continued)

maintaining the state thereof; and a driving circuit comprising a control unit for controlling a voltage or current that is supplied to the first magnetomotive force supplying body and the second magnetomotive force supplying body.

11 Claims, 15 Drawing Sheets

(51) Int. Cl.
*H01F 7/16* (2006.01)
*H01H 47/22* (2006.01)
*H01H 50/36* (2006.01)
*H01H 3/28* (2006.01)

(52) U.S. Cl.
CPC ..... *H01H 50/36* (2013.01); *H01H 3/28* (2013.01); *H01H 2051/2218* (2013.01)

(58) Field of Classification Search
USPC ..... 361/160
See application file for complete search history.

(56) References Cited

U.S. PATENT DOCUMENTS 6,084,492 A * 7/2000 Cereda ..... H01F 7/081 335/220
7,898,121 B2 * 3/2011 Ramsay ..... H02K 41/031 310/101
8,143,817 B2 * 3/2012 Izumi ..... H02K 33/14 310/15
8,324,763 B2 * 12/2012 Gosvener ..... H02K 7/075 310/14
8,710,945 B2 * 4/2014 Wygnanski ..... H01F 7/1646 335/229
9,071,108 B2 * 6/2015 Nakagawa ..... H02K 33/16

FOREIGN PATENT DOCUMENTS

KR 20040035176 A 4/2004
KR 200401042 Y1 11/2005
KR 101068409 B1 9/2011

* cited by examiner

PERMANENT MAGNET OPERATING DEVICE

TECHNICAL FIELD

The present disclosure relates to a permanent magnet operating device, and in particular, to a permanent magnet operating device which may be used in a recloser, or the like, and may be operated with low-energy power.

BACKGROUND ART

This section provides background information related to the present disclosure which is not necessarily prior art.

A recloser is a type of a breaking device which is configured so as to, if a failure occurs in an overhead line, automatically detect the same and break a power supplied thereto through opening the line, and if the failure is overcome, supply the power through automatically connecting the line, and is a device which is installed on the overhead line to protect a transformer upon the occurrence of an over load or abnormal state, and prevent the extent of electrical failure from being enlarged. When classifying the recloser depending on an operating mechanism, it may be divided into a type using a spring and a rotary motor, and a type using a permanent magnet operating device (hereinafter, also referred to as a permanent magnet actuator, PMA). The recloser using the permanent magnet actuator may be manufactured in a simpler structure, and used in a higher frequency of use due to a high reliability in operation than the type using the spring. The permanent magnet actuator may be manufactured in a small size but generate a large force, and in particular, has characteristics of being capable of generating a very large force at each end of a stroke, which is ideally suited to the requirement of a greater holding force when the line is opened or connected in the recloser.

The permanent magnet actuator is an actuator which is configured so that a movable element reciprocates by a coercive force of a permanent magnet and a magnetomotive force derived from a coil. There are one-coil type and two-coil type permanent magnet actuators, and the two-coil type permanent magnet actuator is more frequently applied for use as a recloser.

A structure of a general permanent magnet actuator is already well known in the art through Korean Patent Laid-Open Publication No. 10-2004-0035176, Korean Utility Model Registration Publication No. 20-0401042, and the like.

FIG. 1 is a view illustrating an operation principle of a conventional two-coil type permanent magnet actuator in the related art, and FIG. 2 is a view illustrating an example of a driving circuit for driving the permanent magnet actuator of FIG. 1.

The conventional permanent magnet actuator includes a stator iron core 10, a movable element 20, a permanent magnet 30, a first coil 40 and a second coil 50. The stator iron core 10 is formed by laminating a plurality of iron plates which are magnetic materials, and has a first wall 11 and a second wall 13 which faces the first wall to define a space 15 therein. The movable element 20 is positioned in the space 15 to reciprocate between the first wall 11 and the second wall 13 along an imaginary moving axis connecting the first wall 11 and the second wall 13. In addition, the movable element 20 may include a driving shaft 21 which is disposed in a structure of penetrating the first wall 11 and the second wall 13 to guide a reciprocation thereof. Further, when being used in an apparatus such as the recloser, the above-described driving shaft 21 plays a role of an element for connecting the permanent magnet actuator with another mechanical element. The first coil 40 and the second coil 50 serve to provide the magnetomotive force to the movable element 20 for reciprocating the same. Herein, the first coil 40 is located on the first wall 11 side, and the second coil 50 is located on the second wall 13 side in the space 15. The permanent magnet 30 is disposed between the first coil 40 and the second coil 50 to provide the coercive force to the movable element 20. The first coil 40 and the second coil 50 are wound in a direction orthogonal to a direction in which the movable element 20 moves, respectively, and thus to generate magnetomotive forces in different directions from each other.

FIG. 1*a* illustrates a state that the movable element 20 is positioned on the first wall 11 side in which the first coil 40 is located in the space 15 inside the stator iron core 10. In this case, the movable element is maintained with being attached to the first wall 11 due to a coercive force M1 provided by the permanent magnet 30. In this state, as illustrated in FIG. 1*b*, when a current is supplied to the second coil 50 by closing a switching device 51 connected to the second coil 50 by a control unit 60, a second wall-direction magnetomotive force E2 is generated in the second coil 50, and when a second wall-direction force which is larger than a force that pulls the movable element 20 by the coercive force M1 of the permanent magnet 30 is generated by the second wall-direction magnetomotive force E2, the movable element 20 moves to the second wall 13 side in which the second coil 50 is located. As a result, the movable element 20 is maintained with being attached to the second wall 13. In this state, even when the current is not supplied to the second coil 50 by opening the switching device 51 connected to the second coil 50, the movable element 20 is maintained with being attached to the second wall 13 by a coercive force M2 provided by the permanent magnet 30, as illustrated in FIG. 1*c*. In this state, when the current is supplied to the first coil 40 by closing a switching device 41 connected to the first coil 40 by the control unit 60, a first wall-direction magnetomotive force E1 is generated in the first coil 40, and as illustrated in FIG. 1*d*, when a first wall-direction force which is larger than a force that pulls the movable element 20 by the coercive force M2 of the permanent magnet 30 is generated by first wall-direction magnetomotive force E1, the movable element 20 moves to the first wall 11 side in which the first coil 40 is located. In this state, even when the current is not supplied to the first coil 40 by opening the switching device 41 connected to the first coil 40, the movable element 20 is maintained with being attached to the first wall 11 by the coercive force M1 provided by the permanent magnet 30, as illustrated in FIG. 1*a*.

In the operation principle of the permanent magnet actuator as described above, in order to move the movable element 20 stopped with being attached to the first wall 11 or the second wall 13 to an opposite wall side, it is necessary for the second coil 50 or the first coil 40 located at opposite sides to generate a force larger than the force that pulls the movable element 20 by the coercive force M1 or M2 of the permanent magnet 30. Therefore, a large amount of current should be supplied to the first or second coil to obtain the larger magnetomotive force E2 or E1. When applied for use in the recloser, the permanent magnet actuator should be supplied with the current through a capacitor. Therefore, supplying a large amount of current means that there is no choice but requiring a large capacitance of capacitor, and increasing a current capacity of the devices used in the driving circuit, as well as, this may be a factor to hinder a decrease in a size of the recloser, and to increase production costs.

FIG. 3 is a view illustrating another example of the conventional permanent magnet actuator in the related art, and FIG. 4 is another example of the conventional permanent magnet actuator in the related art.

The permanent magnet actuators illustrated in FIGS. 3 and 4 are adapted to reduce the supplied current, and may be configured so as to provide a large holding force at one end of a stroke (in order to maintain a pressure of circuit contacts), while provide a relative smaller holding force at the other end of the stroke. For example, as illustrated in FIG. 3, when including a groove 12 on the first wall 11 side capable of housing a portion of the movable element 20, a smaller holding force is applied to the movable element 20 with being located on the first wall 11 side in which the groove 12 is positioned, while a larger holding force is applied thereto with being located on the second wall 13 side. Herein, the groove 12 serves to prevent a rapid change in a permeance with respect to a displacement of the movable element 20 (the holding force is proportional to a variation in the permeance according to the displacement of the movable element). As another example, as illustrated in FIG. 4, when including a non-magnetic material 16 disposed between the first wall 11 and the movable element 20, a smaller holding force is applied to the movable element 20 with being located on the first wall 11 side in which the non-magnetic material 16 is positioned, while a larger holding force is applied thereto with being located on the second wall 13 side (also in this case, the variation in the permeance according to the displacement of the movable element 20 is decreased). As described above, when the holding force acting on the movable element 20 may be smaller, it is advantageous since the amount of current that should be supplied to the coil of the opposite side (the second coil in FIGS. 3 and 4) for moving the movable element to the opposite side can be reduced. However, also in the case of the permanent magnet actuators illustrated in FIGS. 3 and 4, when the movable element 20 is located on the second wall 13 side, the holding force is large (in order to maintain the pressure of the circuit contacts, it is not possible to decrease the holding force). Therefore, in order to move the movable element to the first wall 11 side, it is still necessary to supply a large amount of current to the first coil 40.

DISCLOSURE

Technical Problem

For this, objects of the present disclosure will be described at an end section of the 'Best Mode.'

Technical Solution

This section provides a general summary of the disclosure and is not a comprehensive disclosure of its full scope or all of its features.

According to one aspect of the present disclosure, there is provided a permanent magnet actuator including: a stator iron core having a first wall and a second wall which faces the first wall to define a space therein; a movable element which is positioned in the space to reciprocate between the first wall and the second wall along a moving axis connecting the first wall and the second wall; a first magnetomotive force supplying body and a second magnetomotive force supplying body each of which are located on a first wall side and a second wall side in the space so as to provide a magnetomotive force to the movable element for reciprocating the same, wherein at least one of the first magnetomotive force supplying body and the second magnetomotive force are configured to selectively generate a bidirectional magnetomotive force; a permanent magnet which is disposed between the first magnetomotive force supplying body and the second magnetomotive force supplying body to provide a coercive force to the movable element for maintaining a state thereof; and a driving circuit which includes a control unit configured to control a voltage or a current supplied to the first magnetomotive force supplying body and the second magnetomotive force supplying body.

Advantageous Effects

For this, effects of the present disclosure will be described at the end section of the 'Best Mode.'

BEST MODE

The present disclosure will now be described in detail with reference to the accompanying drawings.

Figure 5A:
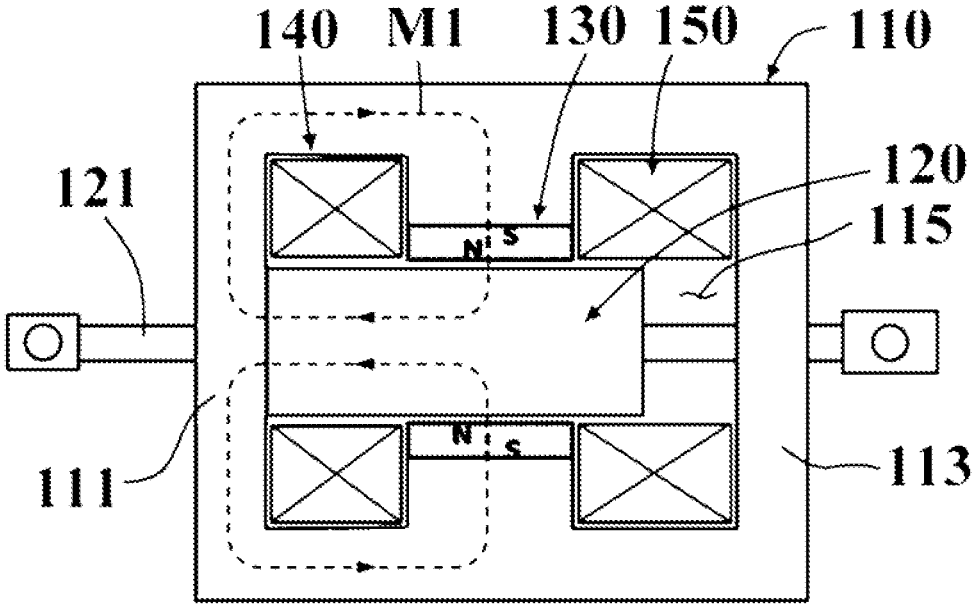
FIG. 5 is a view illustrating an operation principle of a permanent magnet actuator according to the present disclosure.
Figure 5B:
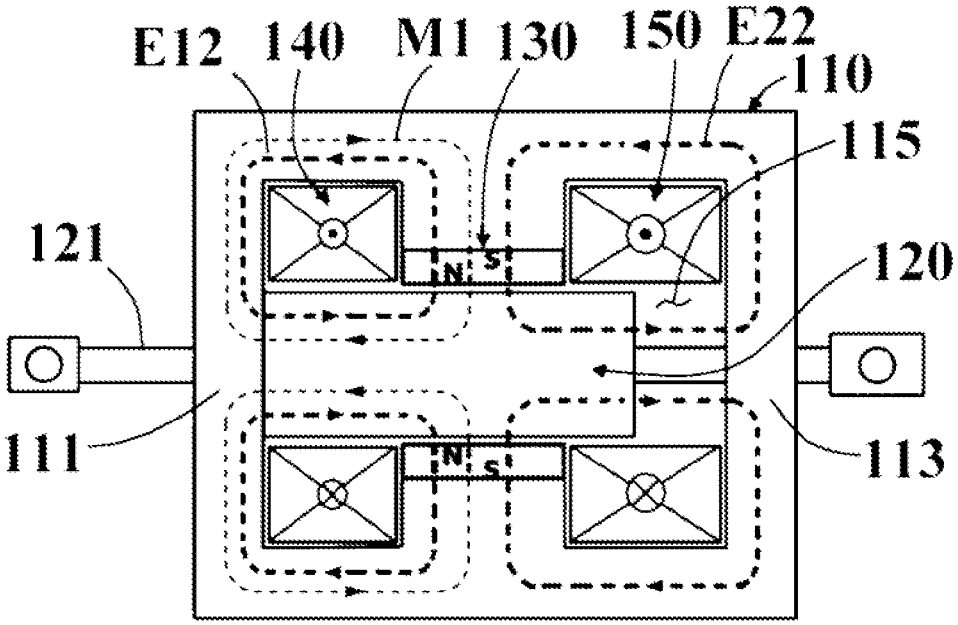
Figure 5C:
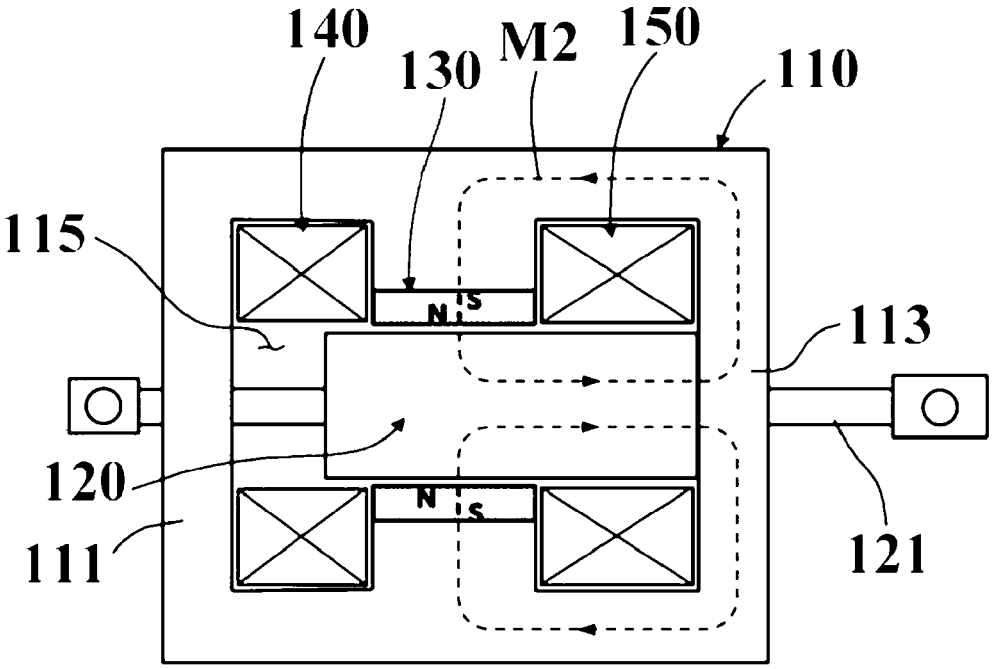
Figure 5D:
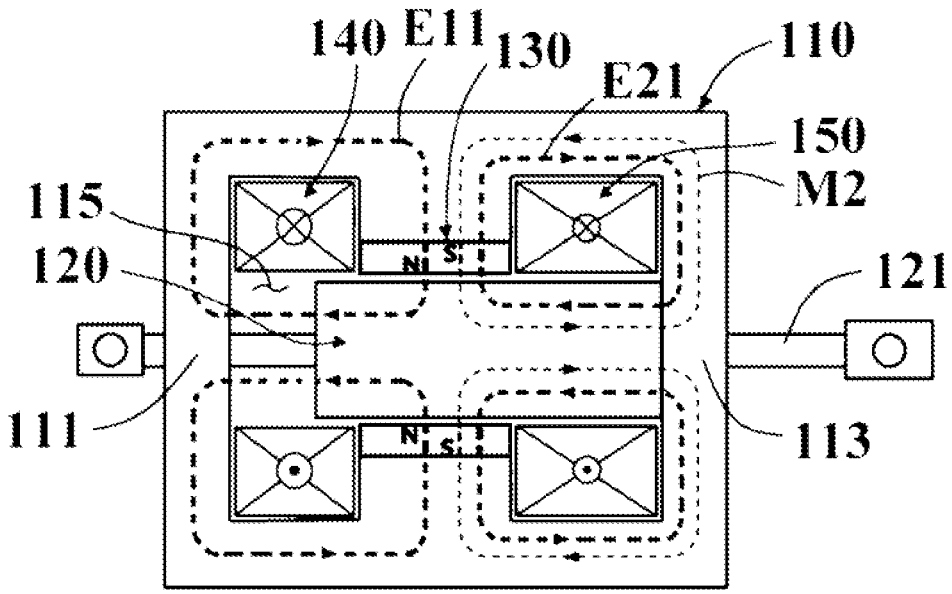
Figure 6:
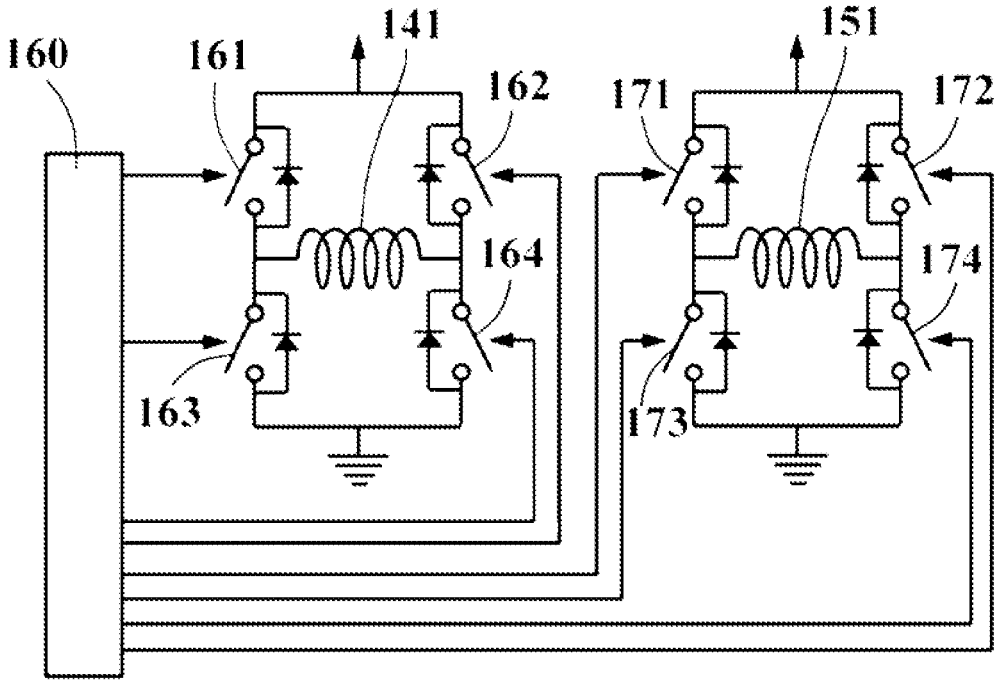
FIG. 6 is a view illustrating an example of a driving circuit for driving the permanent magnet actuator according to the present disclosure.

FIG. 5 is a view illustrating an operation principle of a permanent magnet actuator according to the present disclosure, and FIG. 6 is a view illustrating an example of a driving circuit for driving the permanent magnet actuator according to the present disclosure.

The permanent magnet actuator according to the present disclosure includes a stator iron core 110, a movable element 120, a permanent magnet 130, a first magnetomotive force supplying body 140, and a second magnetomotive force supplying body 150.

The stator iron core 110 is formed by laminating a plurality of iron plates which are magnetic materials, and has a first wall 111 and a second wall 113 which faces the first wall 111 to define a space 115 therein.

The movable element 120 is positioned in the space 115 to reciprocate between the first wall 111 and the second wall 113 along an imaginary moving axis connecting the first wall 111 and the second wall 113. In addition, the movable element 120 may include a driving shaft 121 which is disposed in a structure of penetrating the first wall 111 and the second wall 113 to guide a reciprocation thereof. Further, when being used in an apparatus such as the recloser, the above-described driving shaft 121 plays a role of an element for connecting the permanent magnet actuator with another mechanical element.

The first magnetomotive force supplying body 140 and the second magnetomotive force supplying body 150 serve to provide magnetomotive force E11, E12, E21 and E22 to the movable element 120 for reciprocating the same. Herein, the first magnetomotive force supplying body 140 is located on the first wall 111 side, and the second magnetomotive force supplying body 150 is located on the second wall 113 side in the space 115.

The permanent magnet 130 is disposed between the first magnetomotive force supplying body 140 and the second magnetomotive force supplying body 150 to provide a coercive force to the movable element 120 for maintaining a state thereof.

The first magnetomotive force supplying body 140 includes a first coil 141, and the second magnetomotive force supplying body 150 includes a second coil 151. Each of the first magnetomotive force supplying body 140 and the second magnetomotive force supplying body 150 may be provided in a form including a bobbin for winding the first coil 141 and the second coil 151, or may be provided in a form excluding the bobbin. The first coil 141 is wound in a direction so as to generate a first wall-direction magnetomotive force E11 during supplying a forward current, while the second coil 151 is wound in a direction so as to generate a second wall-direction magnetomotive force E22 during supplying the forward current.

As illustrated in FIG. 6, in the driving circuit, each of the first coil 141 and the second coil 151 is independently connected with a control unit 160. In addition, in order to selectively supply the forward current and reverse current, the first coil 141 is connected with four switching devices 161, 162, 163 and 164, and the second coil 151 is connected with four switching devices 171, 172, 173 and 174.

The switching devices may be an electronic device such as a FET, transistor, or IGBT, and may be a device having a mechanical operating part and electrical contacts such as a breaker, relay, or on-off switch. The control unit 160 may control the opening and closing of the switching devices so as not to flow a current to the separate coils, or so as to flow the current in a desired direction, and may be configured so as to quantitatively control the current supplied to the coils through a pulse width modulation (PWM) control.

The control unit 160 controls so as to selectively open/close the four switching devices 161, 162, 163 and 164 connected with the first coil 141, and the four switching devices 171, 172, 173 and 174 connected with the second coil 151, and thereby changing the direction of the current supplied to the first coil 141 and the second coil 151 between the forward direction and reverse direction.

Specifically, the control unit 160 controls the permanent magnet actuator in a method as described below.

First, as illustrated in FIG. 5*a*, when the movable element 120 is positioned on the first wall 111 side in which the first magnetomotive force supplying body 140 is located in the space 115 inside the stator iron core 110, the movable element 120 is maintained with being attached to the first wall 111 by a coercive force M1 provided by the permanent magnet 130.

In this state, as illustrated in FIG. 5*b*, if two switching devices 171 and 174 connected to the second coil 151 are closed to supply the forward current by the control unit 160, a pulling type second wall-direction magnetomotive force E22 is generated in the second coil 151, and if two switching devices 161 and 163 connected to the first coil 141 are closed to supply the reverse current, a pushing type second wall-direction magnetomotive force E12 is generated in the first coil 141.

In this case, when a resultant force of a force generated by the pulling type second wall-direction magnetomotive force E22 and a force generated by the pushing type second wall-direction magnetomotive force E12 is larger than the force that pulls the movable element by the coercive force M1 of the permanent magnet 130, the movable element 120 moves to the second wall 113 side in which the second coil 151 is located. As a result, the movable element 120 is maintained with being attached to the second wall 113. In this state, even if all the currents supplied to the coils are broken, the movable element 120 is maintained with being attached to the second wall 113 by a coercive force M2 provided by the permanent magnet 130, as illustrated in FIG. 5*c*.

Figure 1A:
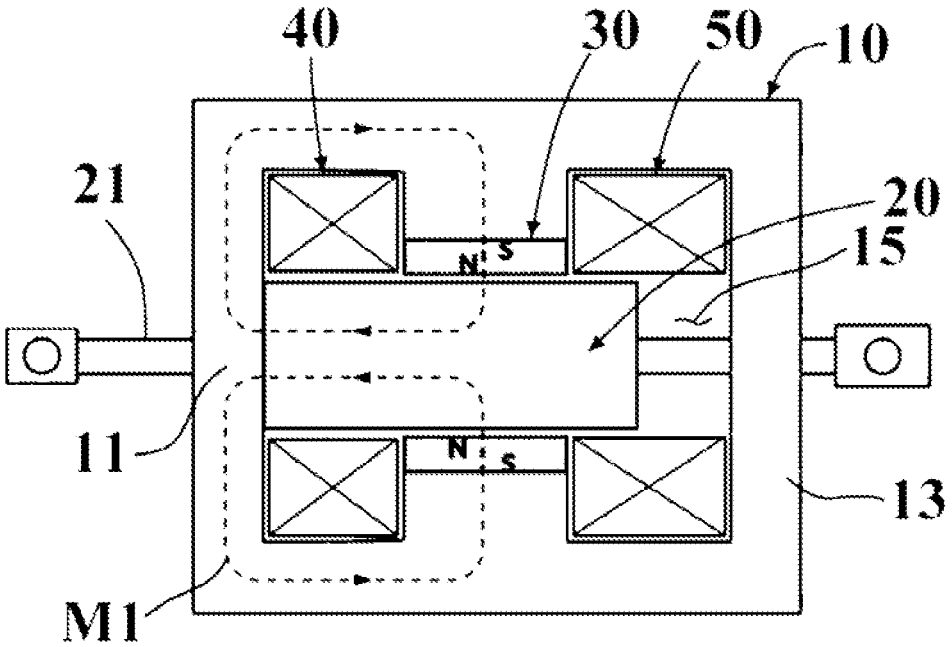
FIG. 1 is a view illustrating an operation principle of a conventional two-coil type permanent magnet actuator in the related art.
Figure 1B:
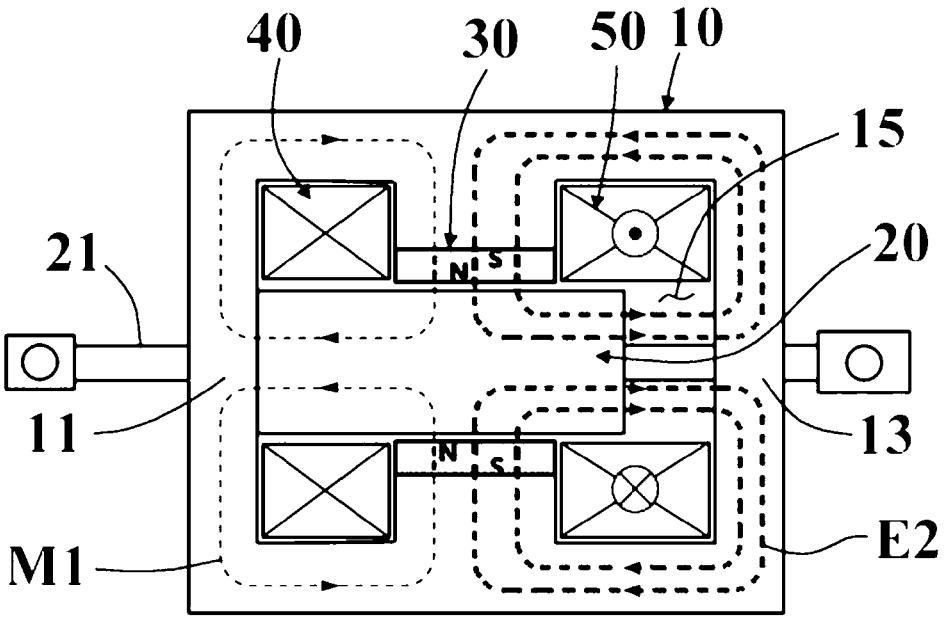
Figure 1C:
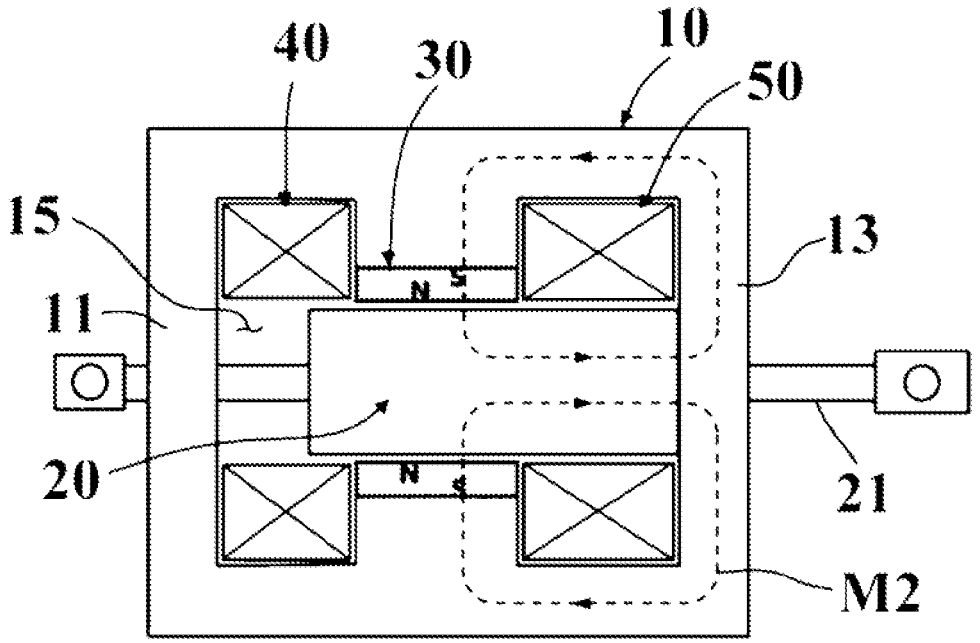

The pushing type second wall-direction magnetomotive force E12 generated in the first coil 141 compensates the coercive force M1 provided by the permanent magnet 130 to decrease a magnitude of the pulling type second wall-direction magnetomotive force E22 required in the second coil 151. Thereby, a current which should be supplied to the second coil 151 for moving the movable element 120 to the second wall 113 side is decreased, compared to when the current is not flowing to the first coil 141 to an extent capable of compensating the coercive force M1 of the permanent magnet 130 (see FIG. 1*b*). In addition, a resultant value of a current which should be supplied to the second coil 151 and a current which should be supplied to the first coil 141 for compensating the coercive force M1 is also should also be smaller than the current amount which should be supplied to the second coil 151 when moving the movable element 120 only by the pulling type second wall-direction magnetomotive force E22 (see FIG. 1*b*). The reason is that, a magnetic resistance of a loop through which magnetic fluxes flow is small due to the movable element 20 being positioned on the first wall 111 side, such that when supplying the same amount of current, the force generated by the pushing type second wall-direction magnetomotive force E12 is relatively larger than the force generated by the pulling type second wall-direction magnetomotive force E22.

As illustrated in FIG. 5*c*, when the movable element 120 is positioned on the second wall 113 side in which the second magnetomotive force supplying body 150 is located in the space 115 inside the stator iron core 110, the movable element 120 is maintained with being attached to the second wall 113 by the coercive force M2 provided by the permanent magnet 130.

In this state, as illustrated in FIG. 5*d*, if two switching devices 161 and 164 connected to the first coil 141 are closed to supply the forward current by the control unit 160, a pulling type first wall-direction magnetomotive force E11 is generated in the first coil 141, and if two switching devices 172 and 173 connected to the second coil 151 are closed to supply the reverse current, a pushing type first wall-direction magnetomotive force E21 is generated in the second coil 151.

In this case, when a resultant force of a force generated by the pulling type first wall-direction magnetomotive force E11 and a force generated by the pushing type first wall-direction magnetomotive force E21 is larger than the force generated by the coercive force M2 of the permanent magnet 130, the movable element 120 moves to the first wall 111 side in which the first coil 141 is located. As a result, the movable element 120 is maintained with being attached to the first wall 111. In this state, even if all the currents supplied to the coils are broken, the movable element 120 is maintained with being attached to the first wall 111 by the coercive force M1 provided by the permanent magnet 130, as illustrated in FIG. 5*a*.

Figure 1D:
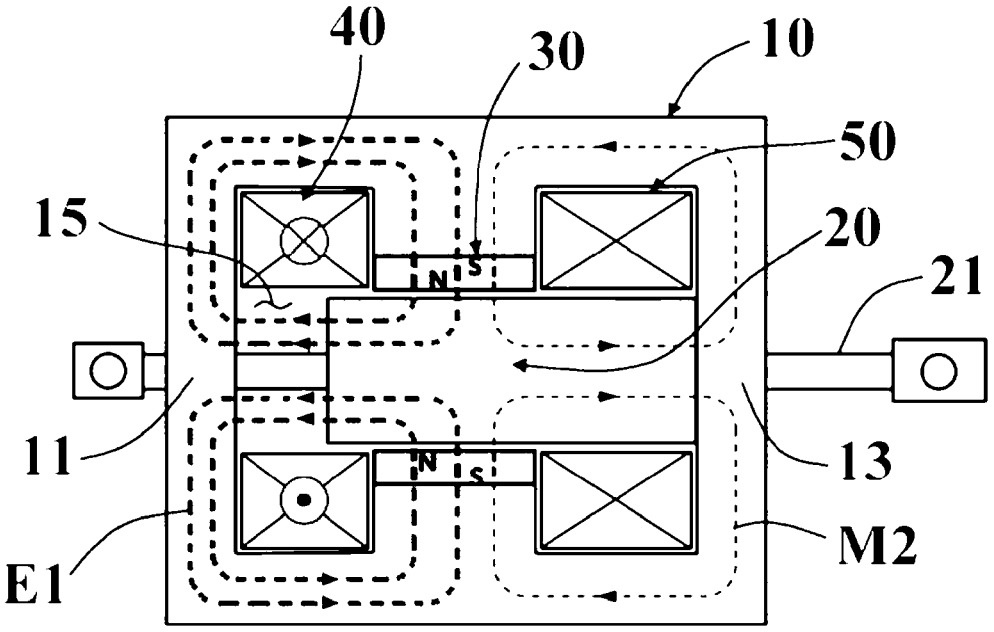
Figure 2:
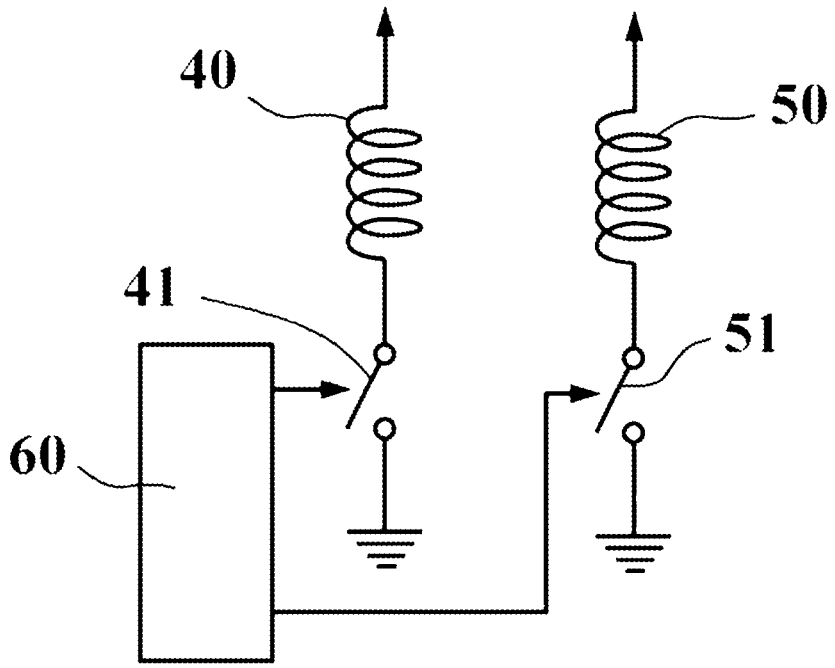
FIG. 2 is a view illustrating an example of a driving circuit for driving the permanent magnet actuator of FIG. 1.

The pushing type first wall-direction magnetomotive force E21 generated in the second coil 151 compensates the coercive force M2 provided by the permanent magnet 130 to decrease the magnitude of the pulling type first wall-direction magnetomotive force E11 required in the first coil 141. Thereby, the current which should be supplied to the first coil 141 for moving the movable element 120 to the first wall 111 side is decreased, compared to when the current is not flowing to the second coil 151 to an extent capable of compensating the coercive force M2 of the permanent magnet 130 (see FIG. 1*d*). In addition, a resultant value of the current which should be supplied to the first coil 141 and the current which should be supplied to the second coil 151 for compensating the coercive force M2 is also smaller than the current amount which should be supplied to the first coil 141 when moving the movable element 120 only by the pulling type first wall-direction magnetomotive force E11 (see FIG. 1*d*). The reason is that, the magnetic resistance of the loop through which magnetic fluxes flow is small due to the movable element 20 being positioned on the second wall 113 side, such that when supplying the same amount of current, the force generated by pushing type first wall-direction magnetomotive force E21 is relatively larger than the force generated by the pulling type first wall-direction magnetomotive force E11.

TABLE 1

| | Coil1 (AT) | | | | |
|---|---|---|---|---|---|
| Coil2 (AT) | 0 | 1000 | 2000 | 3000 | 4000 |
| 0 | −5969 | −3976 | −1797 | −215 | 169 |
| 2000 | −5472 | −3317 | −1146 | 89 | 260 |
| 4000 | −4857 | −2599 | −521 | 356 | |
| 6000 | −4170 | −1891 | 2 | | |
| 8000 | −3477 | −1114 | 460 | | |
| 10000 | −2589 | −367 | | | |
| 12000 | −1707 | 416 | | | |
| 14000 | −803 | 1046 | | | |
| 16000 | 104 | | | | |

[Thrust depending on coil current in two-coil type permanent magnet actuator of 600 kgf class (Unit N) (first coil: ø1.9 320 turn, second coil: ø1.7 320 turn, stator iron core: 203 mm×180.5 mm×110 mm, permanent magnet: N38 50 mm×100 mm×10 mm)]

Table 1 shows results of a finite element analysis, when supplying the current to the first coil and the second coil of the permanent magnet actuator manufactured in a holding force of 600 kgf class according to the present disclosure.

Table 1 relates to the case of moving the movable element 120 to the second wall 113 side with being attached to the first wall 111, and the second column of Table 1 shows the results when the current is not flowing to the first coil 141, that is, when operating in the driving method of the conventional permanent magnet actuator. Referring to Table 1, it can be seen that, when the current is not supplied to the second coil 151, the holding force by the permanent magnet 130 was about 6,000 N, and the direction of the force was changed in a positive direction when a magnetomotive force of 16,000 ampere-turn (AT) was applied to the second coil 151 (the movable element 120 attached to the first wall 111 is separated from the first wall 111 to move to the second wall 113 side). However, it can be seen that, when providing the pushing type magnetomotive force by supplying the reverse current to the first coil 141 according to the present disclosure, the current required for moving the movable element 120 to the second wall 113 side was rapidly decreased (for example, when a magnetomotive force of 3,000 AT is applied to the first coil 141, the movable element 120 moves to the second wall 113 side even if only the magnetomotive force of 2,000 AT is applied to the second coil 151).

The amount of pulling type magnetomotive forces E11 and E22 generated in the first and second magnetomotive force supplying bodies 140 and 150 may be increased or decreased by quantitatively controlling the forward current supplied to the first coil 141 and the second coil 151 by the control unit 160. In addition, the amount of the pushing type magnetomotive forces E12 and E21 generated in the first and second magnetomotive force supplying bodies 140 and 150 may be increased or decreased by quantitatively controlling the reverse current supplied to the first coil 141 and the second coil 151 by the control unit 160. The pushing type magnetomotive forces E12 and E21 may be increased beyond the extent capable of sufficiently compensating the coercive forces M1 and M2 provided by the permanent magnet 130. In this case, even if not generating the pulling type magnetomotive forces E22 and E11, the movable element 120 may move to the opposite side only by the pushing type magnetomotive forces E12 and E21 (Table 1 shows the above-described case, when a magnetomotive force of 4,000 AT is applied to the first coil without supplying the current to the second coil).

As described above, the first magnetomotive force supplying body 140 and the second magnetomotive force supplying body 150 may selectively generate the first wall-direction magnetomotive forces E11 and E21, and the second wall-direction magnetomotive forces E22 and E12 by the control of the control unit 160, such that it is possible to drive the permanent magnet actuator with a small amount of current. Driving the permanent magnet actuator with a small amount of current means that the capacitance of the capacitor and the current capacity of the devices used in the driving circuit may be reduced in constituting the recloser, such that it is possible to reduce costs required to manufacture the recloser. In addition, driving the permanent magnet actuator with a small amount of current allows the permanent magnet actuator to be manufactured in a smaller size by reducing the size of the coils. In the conventional permanent magnet actuator, since the movable element 20 moves only by the pulling type magnetomotive force with the holding force by the permanent magnet being maintained, it is difficult to obtain a long stroke. On the other hand, in the permanent magnet actuator according to the present disclosure, since the movable element 20 moves by the pulling type magnetomotive force with the holding force by the permanent magnet being compensated using the pushing type magnetomotive force, a long stroke may be obtained, and thereby it is possible to be used in the recloser of a medium-voltage distribution lines.

Figure 7:
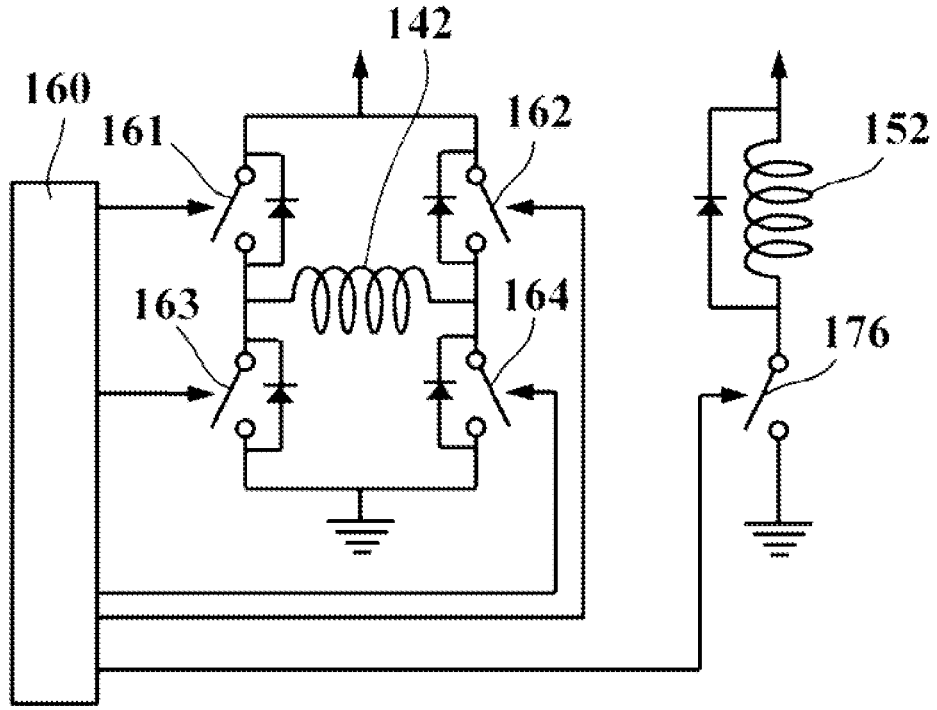
FIG. 7 is a view illustrating another example of the driving circuit for driving the permanent magnet actuator according to the present disclosure.

FIG. 7 is a view illustrating another example of the driving circuit for driving the permanent magnet actuator according to the present disclosure.

The driving circuit may be configured so as to selectively supply the forward current and the reverse current to any one of a first coil 142 included in the first magnetomotive force supplying body 140 and a second coil 152 included in the second magnetomotive force supplying body 150, for example, only to the first coil 142 as illustrated in FIG. 7. For example, each of the first coil 142 and the second coil 152 may be independently connected with the control unit 160, the first coil 142 may be connected with the four switching devices 161, 162, 163 and 164 for selectively supplying the forward current and the reverse current, and the second coil 152 may be connected with one switching devices 176 for controlling opening and closing the circuit.

Figure 3:
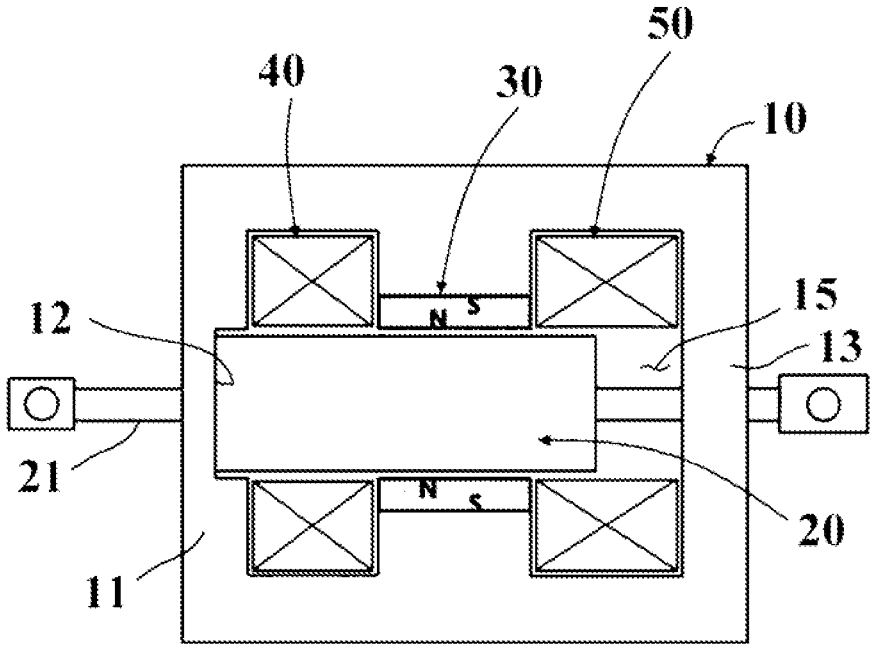
FIG. 3 is a view illustrating another example of the conventional permanent magnet actuator in the related art.
Figure 4:
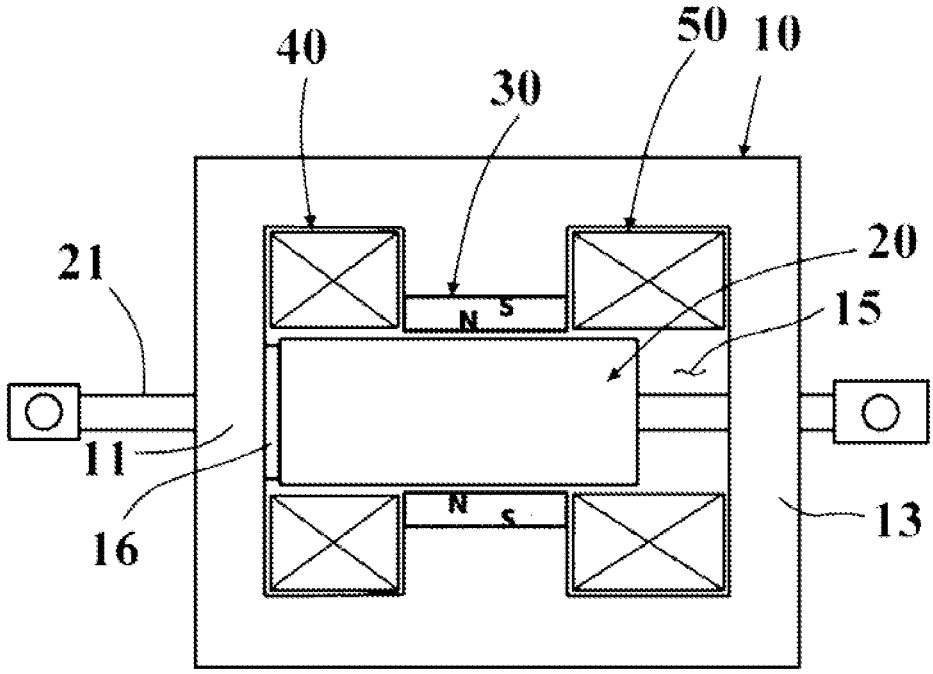
FIG. 4 is another example of the conventional permanent magnet actuator in the related art.

The driving circuit having the above-described configuration may be applied to the case in which the holding force is large at one end of the stroke, and the holding force is small at the other end thereof, as shown in FIGS. 3 and 4. The first coil 142 capable of selectively being supplied with the forward current and the reverse current may be disposed at a side having a large holding force, and the second coil 152 capable of being supplied with only the forward current may be disposed at a side having a small holding force. Accordingly, when moving the movable element 120 from the side having the large holding force to the side having the small holding force, it is possible to have the help of the pushing type magnetomotive force generated in the first coil 142 by supplying the reverse current.

Figure 8:
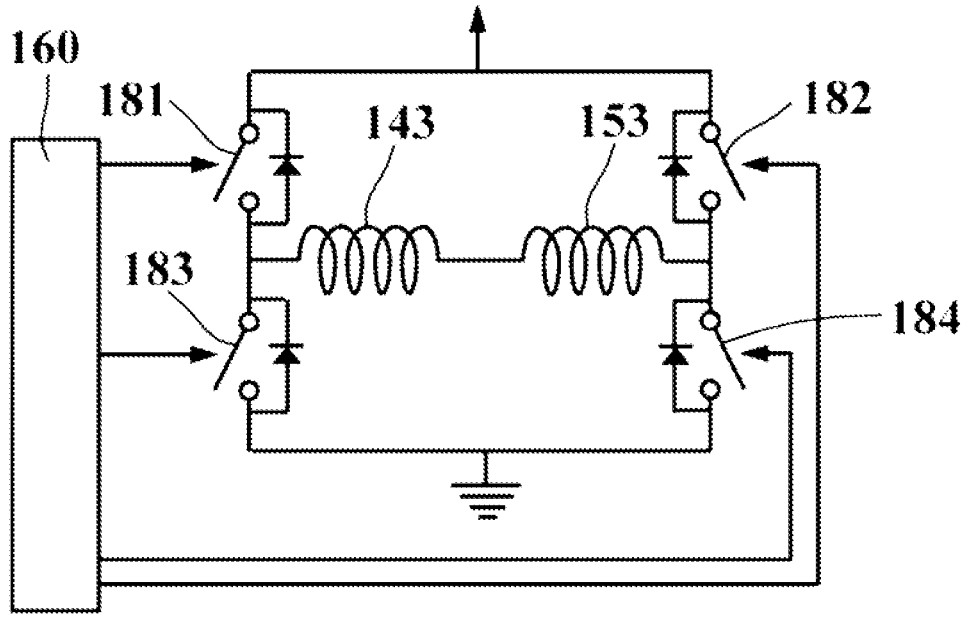
FIG. 8 is a view illustrating another example of the driving circuit for driving the permanent magnet actuator according to the present disclosure.

FIG. 8 is a view illustrating another example of the driving circuit for driving the permanent magnet actuator according to the present disclosure. For reference, in the following embodiments, the forward direction is defined as a direction from a first coil 143 to a second coil 153, and the reverse direction is defined as a direction opposite thereto.

As illustrated in FIG. 8, the driving circuit may be configured in such a manner that the first coil 143 included in the first magnetomotive force supplying body 140 and the second coil 153 included in the second magnetomotive force supplying body 150 are connected with each other in series to selectively supply the forward current and the reverse current to both of the first coil 143 and the second coil 153. The first coil 143 and the second coil 153 connected with each other in series are connected with four switching devices 181, 182, 183 and 184 for selectively supplying the forward current and the reverse current. The control unit 160 controls so as to supply the forward current when the movable element 120 moves from the second wall 113 side to the first wall 111 side, and supply the reverse current when the movable element 120 moves from the first wall 111 side to the second wall 113 side.

According to the driving circuit having the above-described configuration, when supplying the forward current, the pulling type first wall-direction magnetomotive force E11 is generated in the first magnetomotive force supplying body 140, and the pushing type first wall-direction magnetomotive force E21 is generated in the second magnetomotive force supplying body 150, while when supplying the reverse current, the pulling type second wall-direction magnetomotive force E22 is generated in the second magnetomotive force supplying body 150, and the pushing type second wall-direction magnetomotive force E12 is generated in the first magnetomotive force supplying body 140.

Figure 9A:
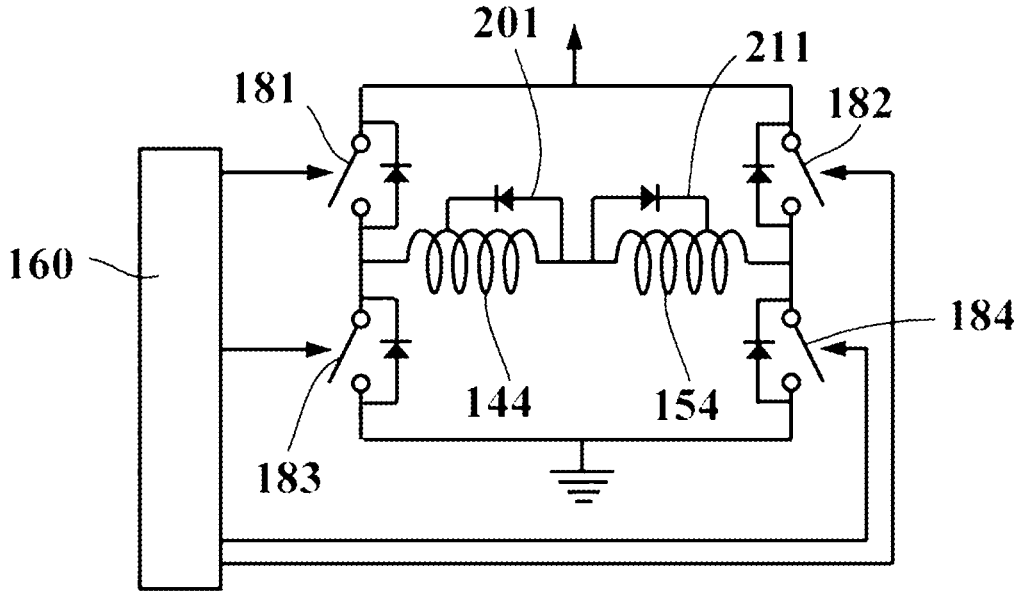
FIG. 9 is a view illustrating another example of the driving circuit for driving the permanent magnet actuator according to the present disclosure.

FIG. 9 is a view illustrating another example of the driving circuit for driving the permanent magnet actuator according to the present disclosure.

As illustrated in FIG. 9, the driving circuit may be configured in such a manner that a first coil 144 included in the first magnetomotive force supplying body 140 and a second coil 154 included in the second magnetomotive force supplying body 150 are connected with each other in series to selectively supply the forward current and the reverse current to both of the first coil 144 and the second coil 154. The first coil 144 and the second coil 154 connected with each other in series are connected with the four switching devices 181, 182, 183 and 184 for selectively supplying the forward current and the reverse current. Further, the driving circuit may include a first rectifying device 201 which is connected from a branch point between the first coil 144 and the second coil 154 to a center tap of the first coil 144 to block the forward current and bypass the reverse current, and a second rectifying device 211 which is connected from a branch point between the first coil 144 and the second coil 154 to a center tap of the second coil 154 to block the reverse current and bypass the forward current. The control unit 160 controls so as to supply the forward current when the movable element 120 moves from the second wall 113 side to the first wall 111 side, and supply the reverse current when the movable element 120 moves from the first wall 111 side to the second wall 113 side. Herein, a position of the center tap is not limited to meaning a precise middle point of the respective coils, and may be located at any position between the opposite ends of the respective coils. For example, the position of the center tap may be defined by coinciding with the magnetomotive force of the coil required for compensating the coercive force of the permanent magnet.

According to the driving circuit having the above-described configuration, similar to the permanent magnet actuator including the driving circuit of FIG. 8, when supplying the forward current, the pulling type first wall-direction magnetomotive force E11 is generated in the first magnetomotive force supplying body 140, and the pushing type first wall-direction magnetomotive force E21 is generated in the second magnetomotive force supplying body 150, while when supplying the reverse current, the pulling type second wall-direction magnetomotive force E22 is generated in the second magnetomotive force supplying body 150, and the pushing type second wall-direction magnetomotive force E12 is generated in the first magnetomotive force supplying body 140.

Figure 9B:
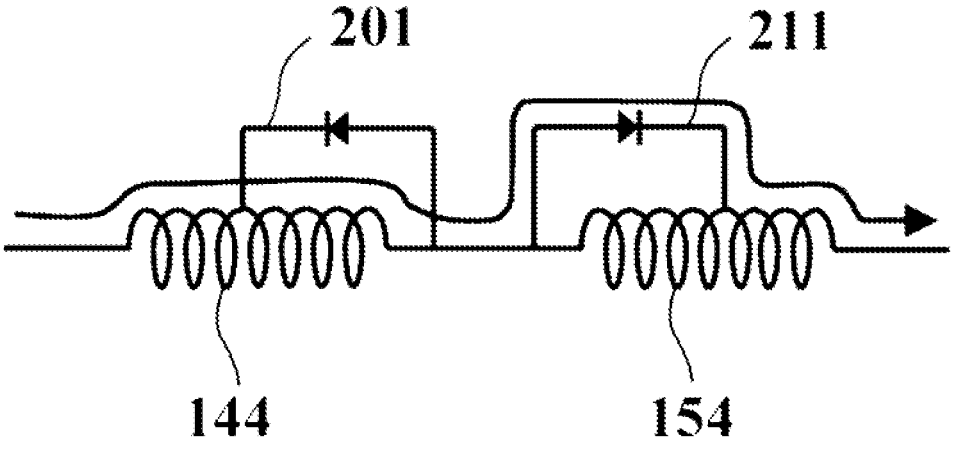
Figure 9C:
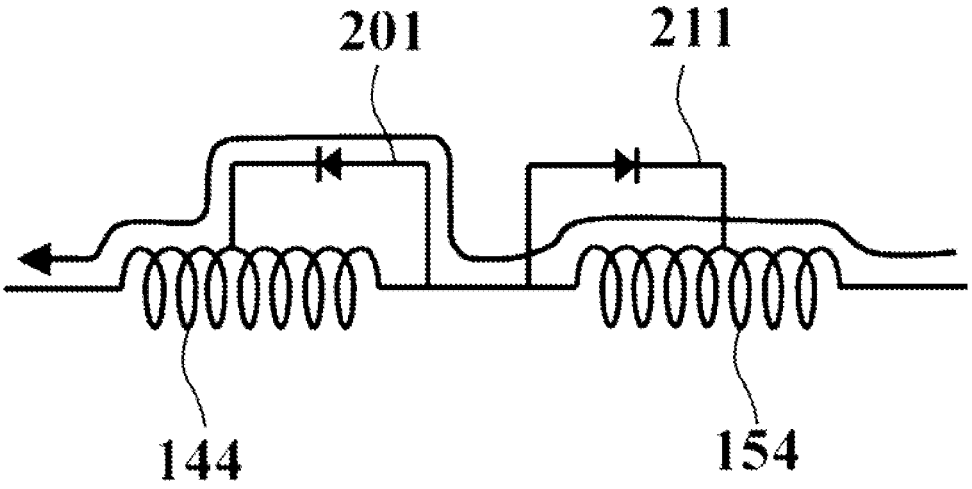

However, when supplying the forward current, as illustrated in FIG. 9*b*, the current flows through an entire region of the first coil 144, while the current flows through only a partial region of the second coil 154 on a downstream side of the second rectifying device 211. Also, when supplying the reverse current, as illustrated in FIG. 9*c*, the current flows through an entire region of the second coil 154, while the current flows through only a partial region of the first coil 144 on a downstream side of the first rectifying device 201. Accordingly, when applying the forward current, a first wall-direction magnetomotive force having a relative smaller magnitude is generated in the second magnetomotive force supplying body 150, while when applying the reverse current, a second wall-direction magnetomotive force having a relative smaller magnitude is generated in the first magnetomotive force supplying body 140. That is, the pulling type magnetomotive force becomes larger.

Figure 10A:
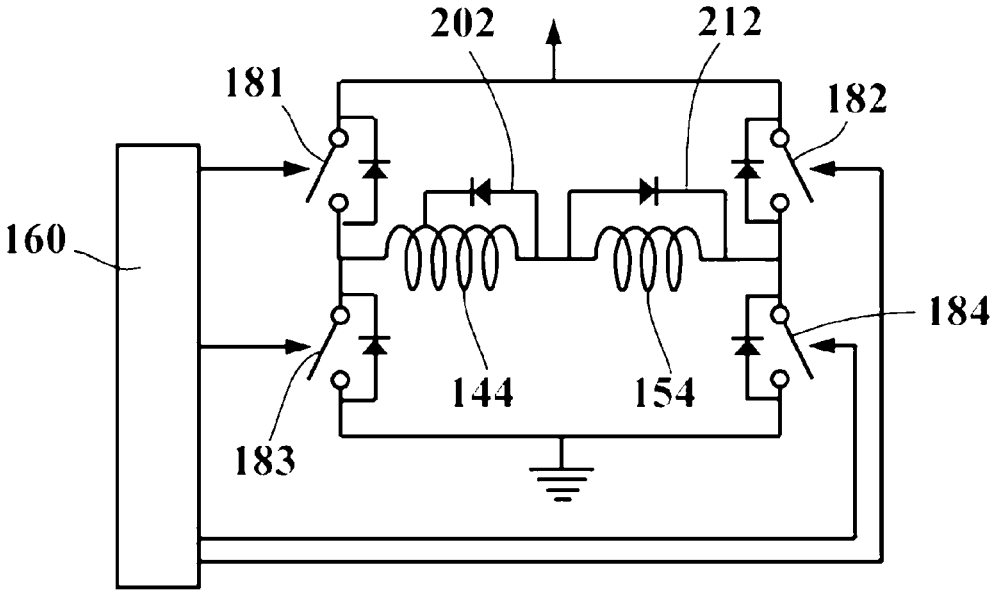
FIG. 10 is a view illustrating another example of the driving circuit for driving the permanent magnet actuator according to the present disclosure.
Figure 10B:
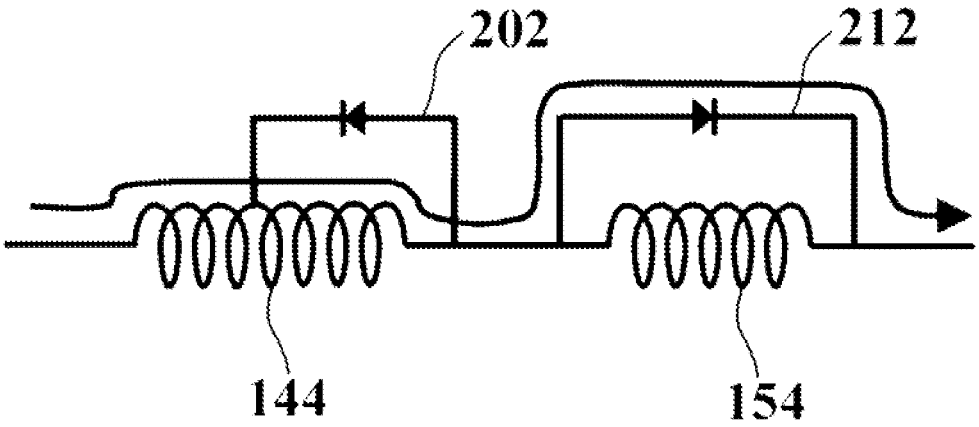
Figure 10C:
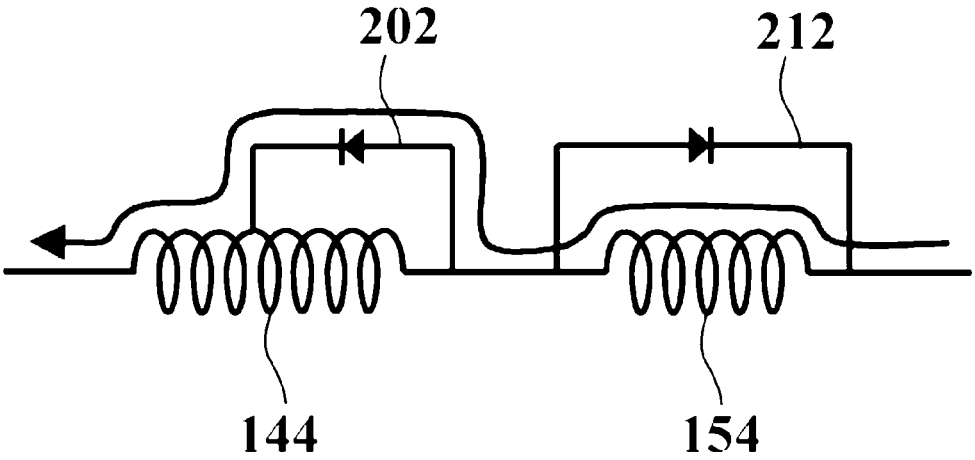

FIG. 10 is a view illustrating another example of the driving circuit for driving the permanent magnet actuator according to the present disclosure.

Unlike the driving circuit illustrated in FIG. 9, the driving circuit may be configured in such a manner that any one of a first rectifying device 202 connected with the first coil 144 and a second rectifying device 212 connected with the second coil 154 bypasses all the forward current or all the reverse current. For example, as illustrated in FIG. 10, the second rectifying device 212 may be connected with the second coil 154 in parallel without branching at the center of the second coil 154. The above-described second rectifying device 212 blocks the reverse current and bypasses all the forward current.

According to the driving circuit having the above-described configuration, when supplying the forward current, unlike the permanent magnet actuator including the driving circuit of FIG. 9, the pulling type first wall-direction magnetomotive force E11 is generated in the first magnetomotive force supplying body 140, but the current does not flow in the second coil 154 by bypassing all the current through the second rectifying device 212, such that the pushing type first wall-direction magnetomotive force E21 is not generated in the second magnetomotive force supplying body 150. On the other hand, when supplying the reverse current, similar to the permanent magnet actuator including the driving circuit of FIG. 9, the pulling type second wall-direction magnetomotive force E22 is generated in the second magnetomotive force supplying body 150, and the pushing type second wall-direction magnetomotive force E12 is generated in the first magnetomotive force supplying body 140.

The driving circuit having the above-described configuration may be applied to the case in which the holding force is large at one end of the stroke, and the holding force is small at the other end thereof, as shown in FIGS. 3 and 4. The first coil 144 capable of selectively being supplied with the forward current and the reverse current may be disposed at a side having a large holding force, and the second coil 154 capable of being supplied with only the forward current may be disposed at a side having a small holding force. Accordingly, when moving the movable element 120 from the side having the large holding force to the side having the small holding force, it is possible to have the help of the pushing type magnetomotive force generated in the first coil 144 by supplying the reverse current.

Figure 11A:
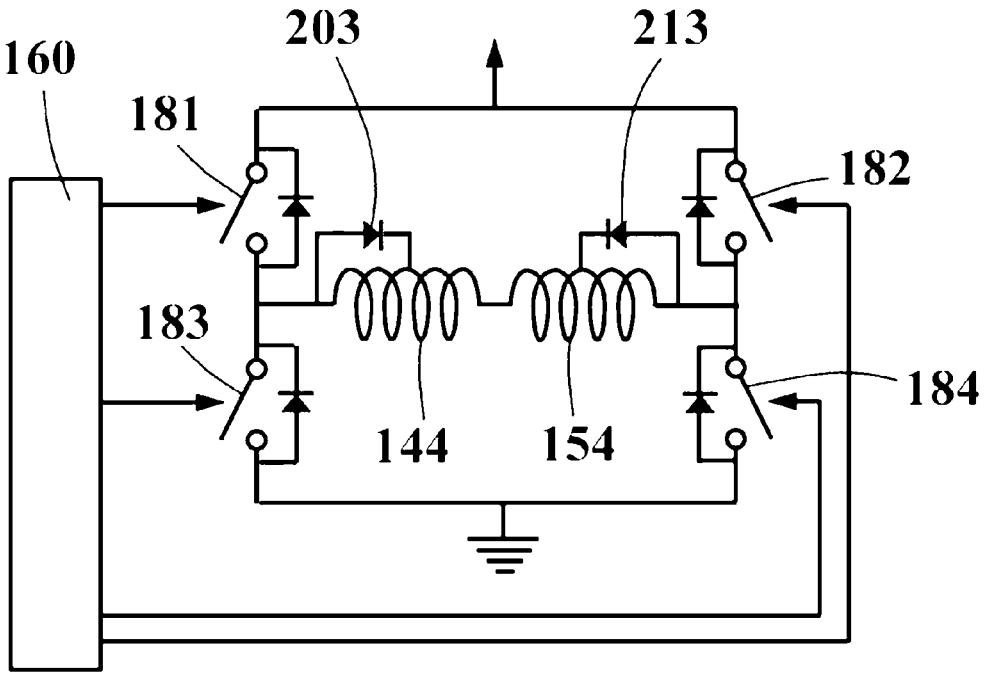
FIG. 11 is a view illustrating another example of the driving circuit for driving the permanent magnet actuator according to the present disclosure.

FIG. 11 is a view illustrating another example of the driving circuit for driving the permanent magnet actuator according to the present disclosure.

As illustrated in FIG. 11, the driving circuit may be configured in such a manner that the first coil 144 included in the first magnetomotive force supplying body 140 and the second coil 154 included in the second magnetomotive force supplying body 150 are connected with each other in series to selectively supply the forward current and the reverse current to both of the first coil 144 and the second coil 154. The first coil 144 and the second coil 154 connected with each other in series are connected with the four switching devices 181, 182, 183 and 184 for selectively supplying the forward current and the reverse current. However, unlike the driving circuit illustrated in FIG. 9, the driving circuit may include a first rectifying device 203 which is connected from a branch point of the first coil 144 on a side opposite to the second coil 154 to the center tap of the first coil 144 to bypass the forward current and block the reverse current, and a second rectifying device 213 which is connected from a branch point of the second coil 154 on a side opposite to the first coil 144 to the center tap of the second coil 154 to bypass the reverse current and block the forward current.

The control unit 160 controls so as to supply the forward current when the movable element 120 moves from the second wall 113 side to the first wall 111 side, and supply the reverse current when the movable element 120 moves from the first wall 111 side to the second wall 113 side. Herein, the position of the center tap is not limited to meaning the precise middle point of the respective coils, and may be located at any position between the opposite ends of the respective coils. For example, the position of the center tap may be defined by coinciding with the magnetomotive force of the coil required for compensating the coercive force of the permanent magnet.

According to the driving circuit having the above-described configuration, similar to the permanent magnet actuator including the driving circuit of FIGS. 8 and 9, when supplying the forward current, the pulling type first wall-direction magnetomotive force E11 is generated in the first magnetomotive force supplying body 140, and the pushing type first wall-direction magnetomotive force E21 is generated in the second magnetomotive force supplying body 150, while when supplying the reverse current, the pulling type second wall-direction magnetomotive force E22 is generated in the second magnetomotive force supplying body 150, and the pushing type second wall-direction magnetomotive force E12 is generated in the first magnetomotive force supplying body 140.

Figure 11B:
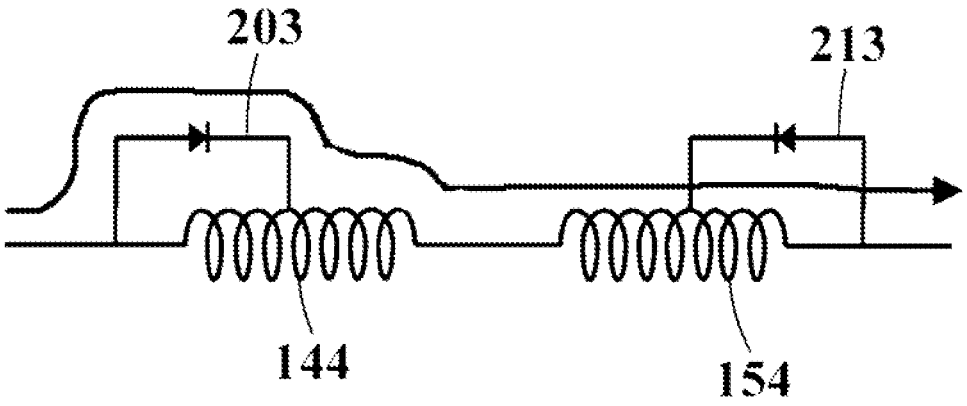
Figure 11C:
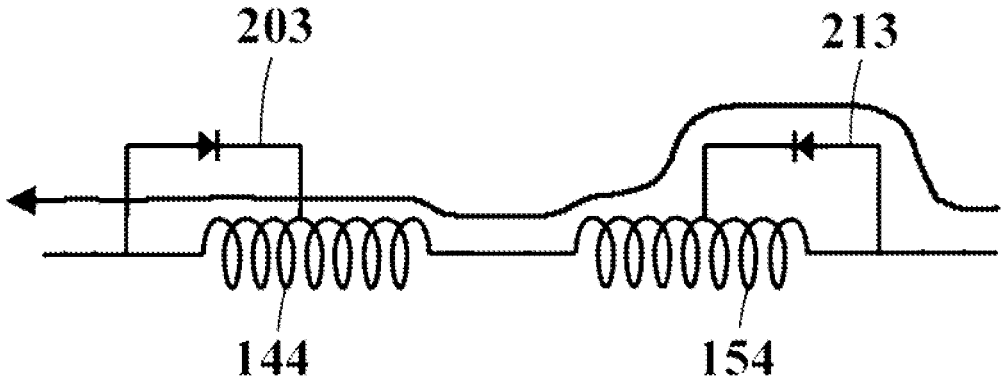

However, when supplying the forward current, as illustrated in FIG. 11*b*, the current flows through an entire region of the second coil 154, while the current flows through only a partial region of the first coil 144 on a downstream side of the first rectifying device 203. Also, when supplying the reverse current, as illustrated in FIG. 11*c*, the current flows through an entire region of the first coil 144, while the current flows through only a partial region of the second coil 154 on a downstream side of the second rectifying device 213. Accordingly, when applying the forward current, a first wall-direction magnetomotive force having a relative larger magnitude is generated in the second magnetomotive force supplying body 150, while when applying the reverse current, a second wall-direction magnetomotive force having a relative larger magnitude is generated in the first magnetomotive force supplying body 140. That is, the pushing type magnetomotive force becomes larger.

Figure 12A:
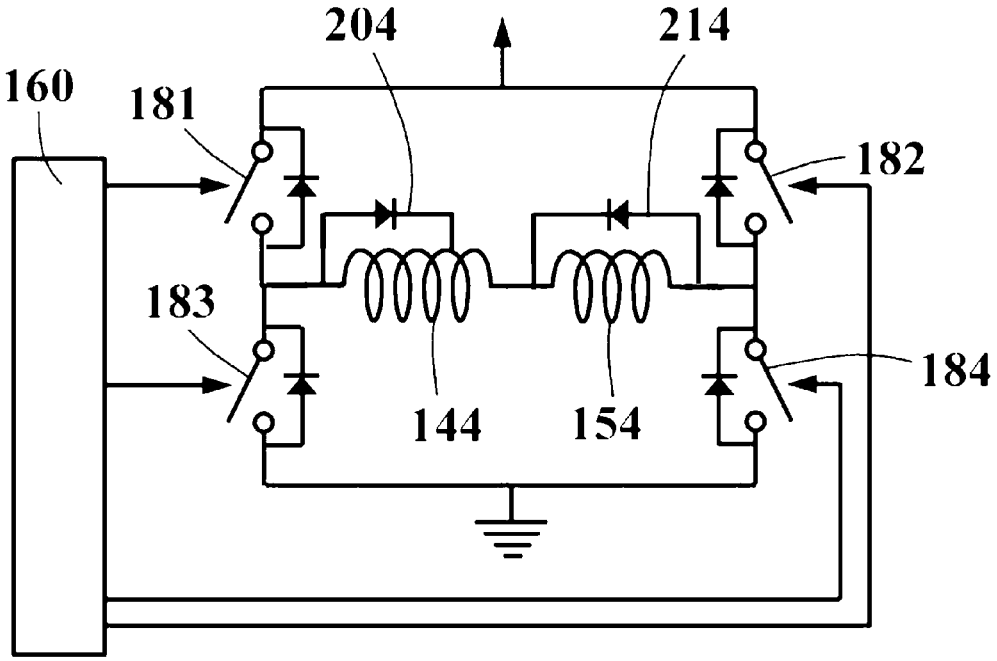
FIG. 12 is a view illustrating another example of the driving circuit for driving the permanent magnet actuator according to the present disclosure.
Figure 12B:
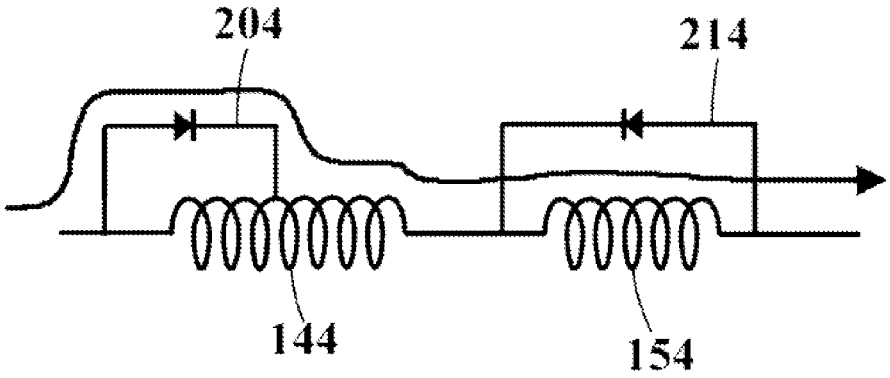
Figure 12C:
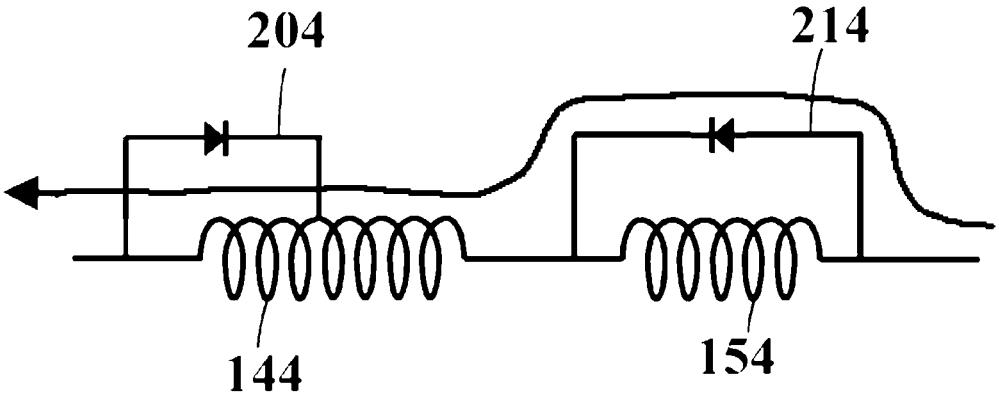

FIG. 12 is a view illustrating another example of the driving circuit for driving the permanent magnet actuator according to the present disclosure.

Unlike the driving circuit illustrated in FIG. 11, the driving circuit may be configured in such a manner that any one of a first rectifying device 204 connected with the first coil 144 and a second rectifying device 214 connected with the second coil 154 bypasses all the forward current or all the reverse current. For example, as illustrated in FIG. 12, the second rectifying device 214 may be connected with the second coil 154 in parallel without branching at the center of the second coil 154. The above-described second rectifying device 214 blocks the forward current and bypasses all the reverse current.

According to the driving circuit having the above-described configuration, when supplying the forward current, unlike the permanent magnet actuator including the driving circuit of FIG. 11, the pulling type first wall-direction magnetomotive force E11 is generated in the first magnetomotive force supplying body 140, and the pushing type first wall-direction magnetomotive force E21 is generated in the second magnetomotive force supplying body 150. However, when supplying the reverse current, unlike the permanent magnet actuator including the driving circuit of FIG. 11, the pushing type second wall-direction magnetomotive force E12 is generated in the first magnetomotive force supplying body 140, but the current does not flow in the second coil 154 by bypassing all the current through the second rectifying device 214, such that the pulling type second wall-direction magnetomotive force E22 is not generated in the second magnetomotive force supplying body 150.

The driving circuit having the above-described configuration may be applied to the case in which the holding force is large at one end of the stroke, and the holding force is small at the other end thereof, as shown in FIGS. 3 and 4. The first coil 144 capable of selectively being supplied with the forward current and the reverse current may be disposed at a side having a small holding force, and the second coil 154 capable of being supplied with only the forward current may be disposed at a side having a large holding force.

Accordingly, when moving the movable element 120 from the side having the large holding force to the side having the small holding force, both of the pulling type magnetomotive force generated in the first coil 144 and the pushing type magnetomotive force generated in the second coil 154 are used, and when moving the movable element in the opposite direction, only the pushing type second wall-direction magnetomotive force generated in the first coil 144 is used.

Figure 13:
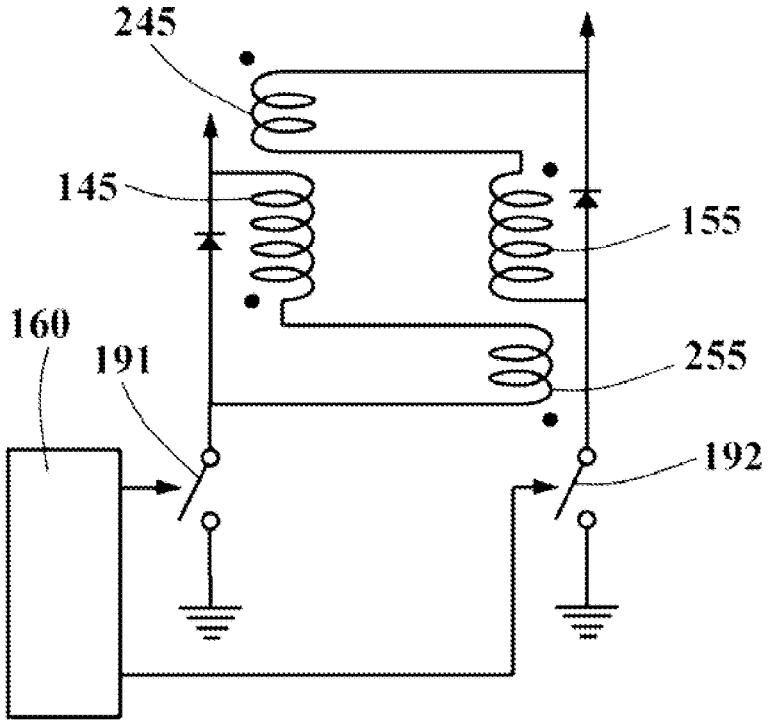
FIG. 13 is a view illustrating another example of the driving circuit for driving the permanent magnet actuator according to the present disclosure.

FIG. 13 is a view illustrating another example of the driving circuit for driving the permanent magnet actuator according to the present disclosure.

The first magnetomotive force supplying body 140 includes a first coil 145 which is wound in a direction so as to generate a first wall-direction magnetomotive force E11 during supplying the current, and a first counter magnetomotive coil 245 which is wound in a direction opposite to that of the first coil 145. The second magnetomotive force supplying body 150 includes a second coil 155 which is wound in a direction so as to generate a second wall-direction magnetomotive force E22 during supplying the current, and a second counter magnetomotive coil 255 which is wound in a direction opposite to that of the second coil 155.

As illustrated in FIG. 13, in the driving circuit, the first coil 145 is connected with the second counter magnetomotive coil 255 in series, and the second coil 155 is connected with the first counter magnetomotive coil 245 in series, as well as each of the both coils is independently connected with the control unit 160 through switching devices 191 and 192. In this case, the control unit 160 controls so as to selectively turn on/off the switching devices 191 and 192, but does not control the same to change the direction of the current supplied thereto.

The control unit 160 may control so as to close the switching device 191 connected with the first coil 145, when moving the movable element 120 from the second wall 113 side to the first wall 111 side, and close the switching device 192 connected with the second coil 155, when moving the movable element 120 from the first wall 111 side to the second wall 113 side.

In the driving circuit having the above-described configuration, when closing the switching device 191 connected with the first coil 145, the current is supplied to the second counter magnetomotive coil 255 as well as the first coil 145, such that the pulling type first wall-direction magnetomotive force E11 is generated in the first magnetomotive force supplying body 140, and the pushing type first wall-direction magnetomotive force E21 is generated in the second magnetomotive force supplying body 150. On the other hand, when closing the switching device 192 connected with the second coil 155, the current is supplied to the first counter magnetomotive coil 245 as well as the second coil 155, such that the pulling type second wall-direction magnetomotive force E22 is generated in the second magnetomotive force supplying body 150, and the pushing type second wall-direction magnetomotive force E12 is generated in the first magnetomotive force supplying body 140. Meanwhile, a ratio of a size between the first coil and the first counter magnetomotive coil, and a size between the second coil and the second counter magnetomotive coil may be controlled so as to generate the pushing type magnetomotive force which is larger than the pulling type magnetomotive force.

Figure 14:
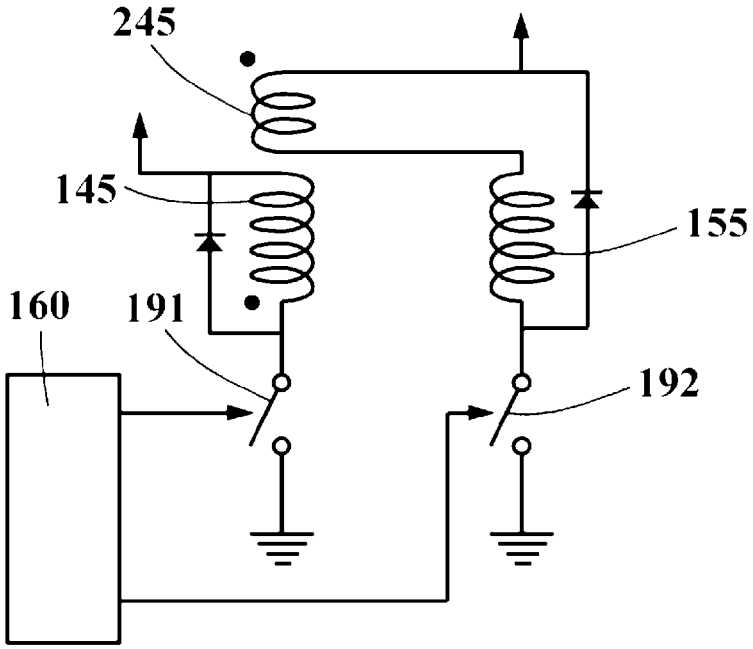
FIG. 14 is a view illustrating another example of the driving circuit for driving the permanent magnet actuator according to the present disclosure.

FIG. 14 is a view illustrating another example of the driving circuit for driving the permanent magnet actuator according to the present disclosure.

FIG. 14 illustrates the driving circuit without the second counter magnetomotive coil 255 included in the second magnetomotive force supplying body 150 illustrated in FIG. 13.

The driving circuit having the above-described configuration may be applied to the case in which the holding force is large at one end of the stroke, and the holding force is small at the other end thereof, as shown in FIGS. 3 and 4. The first magnetomotive force supplying body 140 capable of generating a bidirectional magnetomotive force may be disposed at a side having a large holding force, and the second magnetomotive force supplying body 150 capable of supplying only unidirectional magnetomotive force may be disposed at a side having a small holding force.

Figure 15:
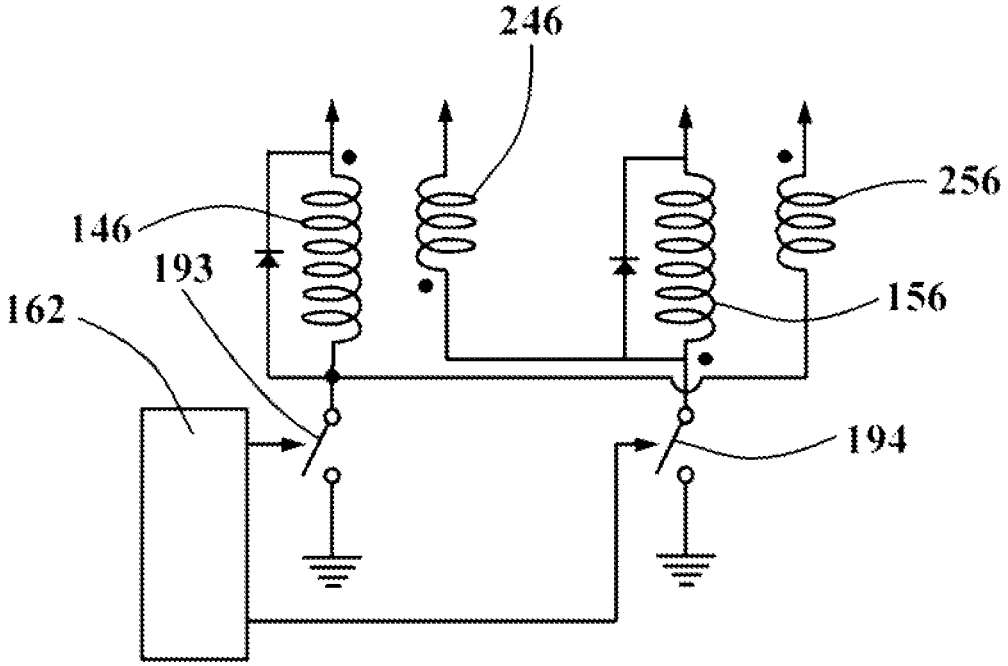
FIG. 15 is a view illustrating another example of the driving circuit for driving the permanent magnet actuator according to the present disclosure.

FIG. 15 is a view illustrating another example of the driving circuit for driving the permanent magnet actuator according to the present disclosure.

The first magnetomotive force supplying body 140 includes a first coil 146 which is wound in a direction so as to generate a first wall-direction magnetomotive force E11 during supplying the current, and a first counter magnetomotive coil 246 which is wound in a direction opposite to that of the first coil 146. The second magnetomotive force supplying body 150 includes a second coil 156 which is wound in a direction so as to generate a second wall-direction magnetomotive force E22 during supplying the current, and a second counter magnetomotive coil 256 which is wound in a direction opposite to that of the second coil 156.

As illustrated in FIG. 15, in the driving circuit, the first coil 146 is connected with the second counter magnetomotive coil 256 in parallel, and the second coil 156 is connected with the first counter magnetomotive coil 246 in parallel, as well as each of the both coils is independently connected with the control unit 160 through switching devices 193 and 194. In this case, the control unit 160 controls so as to selectively turn on/off the switching devices 193 and 194, but does not control the same to change the direction of the current supplied thereto.

The control unit 160 may control so as to close the switching device 193 connected with the first coil 146, when moving the movable element 120 from the second wall 113 side to the first wall 111 side, and close the switching device 194 connected with the second coil 156, when moving the movable element 120 from the first wall 111 side to the second wall 113 side.

In the driving circuit having the above-described configuration, when closing the switching device 193 connected with the first coil 146, the current is supplied to the second counter magnetomotive coil 256 as well as the first coil 146, such that the pulling type first wall-direction magnetomotive force E11 is generated in the first magnetomotive force supplying body 140, and the pushing type first wall-direction magnetomotive force E21 is generated in the second magnetomotive force supplying body 150. On the other hand, when closing the switching device 194 connected with the second coil 156, the current is supplied to the first counter magnetomotive coil 246 as well as the second coil 156, such that the pulling type second wall-direction magnetomotive force E22 is generated in the second magnetomotive force supplying body 150, and the pushing type second wall-direction magnetomotive force E12 is generated in the first magnetomotive force supplying body 140. Meanwhile, a ratio of a size between the first coil and the first counter magnetomotive coil, and a size between the second coil and the second counter magnetomotive coil may be controlled so as to generate the pushing type magnetomotive force which is larger than the pulling type magnetomotive force.

Figure 16:
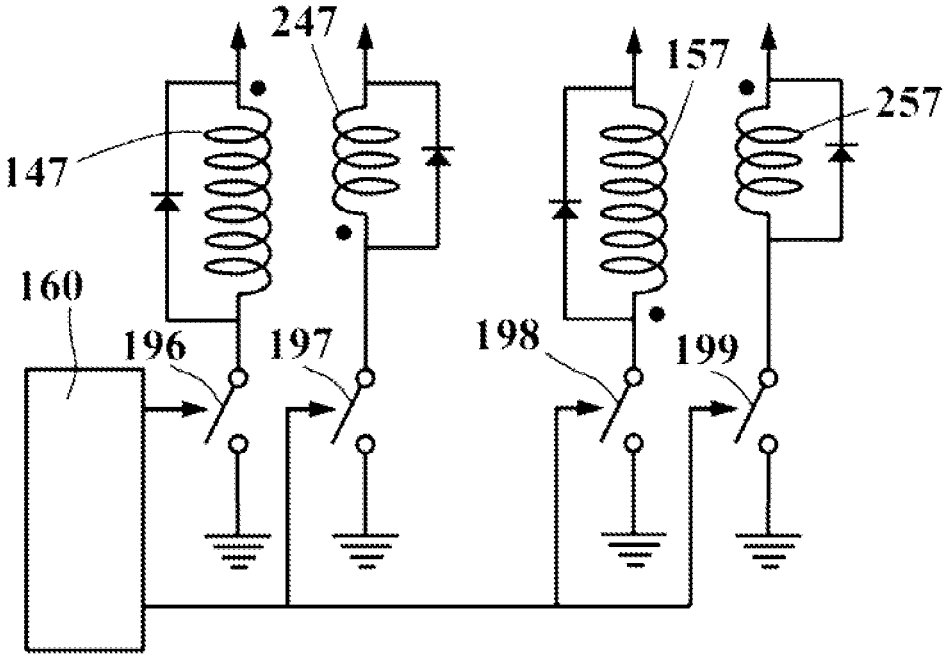
FIG. 16 is a view illustrating another example of the driving circuit for driving the permanent magnet actuator according to the present disclosure.

FIG. 16 is a view illustrating another example of the driving circuit for driving the permanent magnet actuator according to the present disclosure.

The first magnetomotive force supplying body 140 includes a first coil 147 which is wound in a direction so as to generate a first wall-direction magnetomotive force E11 during supplying the current, and a first counter magnetomotive coil 247 which is wound in a direction opposite to that of the first coil 147. The second magnetomotive force supplying body 150 includes a second coil 157 which is wound in a direction so as to generate a second wall-direction magnetomotive force E22 during supplying the current, and a second counter magnetomotive coil 257 which is wound in a direction opposite to that of the second coil 157.

As illustrated in FIG. 16, in the driving circuit, each of the first coil 147, the first counter magnetomotive coil 247, the second coil 157 and the second counter magnetomotive coil 257 is independently connected with the control unit 160 through switching devices 196, 197, 198 and 199. In this case, the control unit 160 controls so as to selectively turn on/off the switching devices 196, 197, 198 and 199, but does not control the same to change the direction of the current supplied thereto.

The control unit 160 may control so as to close the switching device 196 connected with the first coil 147 and the switching device 199 connected with the second counter magnetomotive coil 257, when moving the movable element 120 from the second wall 113 side to the first wall 111 side, and close the switching device 198 connected with the second coil 157 and the switching device 197 connected with the first counter magnetomotive coil 247, when moving the movable element 120 from the first wall 111 side to the second wall 113 side.

In the driving circuit having the above-described configuration, when closing the switching device 196 connected with the first coil 147 and the switching device 199 connected with the second counter magnetomotive coil 257, the current is supplied to these coils, such that the pulling type first wall-direction magnetomotive force E11 is generated in the first magnetomotive force supplying body 140, and the pushing type first wall-direction magnetomotive force E21 is generated in the second magnetomotive force supplying body 150. On the other hand, when closing the switching device 198 connected with the second coil 157 and the switching device 197 connected with the first counter magnetomotive coil 247, the current is supplied to these coils, such that the pulling type second wall-direction magnetomotive force E22 is generated in the second magnetomotive force supplying body 150, and the pushing type second wall-direction magnetomotive force E12 is generated in the first magnetomotive force supplying body 140.

In this case, since the switching devices 196, 197, 198 and 199 can be independently controlled, it is not necessary to control so as to simultaneously turn on/off the switching device 196 connected with the first coil 147 and the switching device 199 connected with the second counter magnetomotive coil 257, and similarly, it is also not necessary to control so as to simultaneously turn on/off the switching device 198 connected with the second coil 157 and the switching device 197 connected with the first counter magnetomotive coil 247. That is, by independently controlling the switching devices 196, 197, 198 and 199, a time for supplying the current to the coils may be controlled in various ways, and the magnitude of the current supplied to the respective coils may be controlled through pulse width modulation, or the like as necessary.

Hereinafter, various embodiment of the present disclosure will be described.

(1) The permanent magnet actuator is characterized in that: the first magnetomotive force supplying body includes a first coil, the second magnetomotive force supplying body includes a second coil, each of the first coil and the second coil is independently connected with a control unit in the driving circuit, and the control unit is configured to control a direction of a current supplied to at least one of the first coil and the second coil to be a forward direction or a reverse direction, so as to selectively generate a first wall-direction magnetomotive force and a second wall-direction magnetomotive force in at least one of the first magnetomotive force supplying body and the second magnetomotive force supplying body.

(2) The permanent magnet actuator is characterized in that: the first magnetomotive force supplying body includes a first coil, the second magnetomotive force supplying body includes a second coil, the first coil and the second coil are connected with each other in series in the driving circuit, and the control unit is configured to control a direction of the current supplied to the first coil and the second coil to be the forward direction from the first coil to the second coil or the reverse direction from the second coil to the first coil, so as to generate a first wall-direction magnetomotive force or a second wall-direction magnetomotive force in both of the first magnetomotive force supplying body and the second magnetomotive force supplying body.

(3) The permanent magnet actuator is characterized in that: the driving circuit includes a first rectifying device which is connected from a branch point between the first coil and the second coil to a center tap of the first coil or from a branch point of the first coil on a side opposite to the second coil to the center tap of the first coil to block a forward current and bypass a reverse current; and a second rectifying device which is connected from a branch point between the first coil and the second coil to a center tap of the second coil or from a branch point of the second coil on a side opposite to the first coil to the center tap of the second coil to block the reverse current and bypass the forward current, such that a magnitude of the magnetomotive force generated in the first magnetomotive force supplying body during applying the forward current is larger than that of the magnetomotive force generated in the first magnetomotive force supplying body during applying the reverse current, and a magnitude of the magnetomotive force generated in the second magnetomotive force supplying body during applying the reverse current is larger than that of the magnetomotive force generated in the second magnetomotive force supplying body during applying the forward current.

(4) The permanent magnet actuator is characterized in that: in the driving circuit, any one of the first rectifying device and the second rectifying device is connected so as to bypass all the current, such that the magnetomotive force is generated only in the first magnetomotive force supplying body during applying the forward current, or the magnetomotive force is generated only in the second magnetomotive force supplying body during applying the reverse current.

(5) The permanent magnet actuator is characterized in that: the driving circuit includes a first rectifying device which is connected from a branch point between the first coil and the second coil to a center tap of the first coil or from a branch point of the first coil on a side opposite to the second coil to the center tap of the first coil to block the reverse current and bypass the forward current; and a second rectifying device which is connected from a branch point between the first coil and the second coil to a center tap of the second coil or from a branch point of the second coil on a side opposite to the first coil to the center tap of the second coil to block the forward current and bypass the reverse current, such that a magnitude of the magnetomotive force generated in the first magnetomotive force supplying body during applying the reverse current is larger than that of the magnetomotive force generated in the first magnetomotive force supplying body during applying the forward current, and a magnitude of the magnetomotive force generated in the second magnetomotive force supplying body during applying the forward current is larger than that of the magnetomotive force generated in the second magnetomotive force supplying body during applying the reverse current.

(6) The permanent magnet actuator is characterized in that: in the driving circuit, any one of the first rectifying device and the second rectifying device is connected so as to bypass all the current, such that the magnetomotive force is generated only in the second magnetomotive force supplying body during applying the forward current, or the magnetomotive force is generated only in the first magnetomotive force supplying body during applying the reverse current.

(7) The permanent magnet actuator is characterized in that: the first magnetomotive force supplying body includes a first coil, the second magnetomotive force supplying body includes a second coil, and further including: at least one of a first counter magnetomotive coil which is included in the first magnetomotive force supplying body together with the first coil to generate a magnetomotive force of a direction opposite to the first coil, and a second counter magnetomotive coil which is included in the second magnetomotive force supplying body together with the second coil to generate a magnetomotive force of a direction opposite to the second coil.

(8) The permanent magnet actuator is characterized in that: in the driving circuit, the first coil is connected with the second counter magnetomotive coil in series, and the second coil is connected with the first counter magnetomotive coil in series.

(9) The permanent magnet actuator is characterized in that: in the driving circuit, the first coil is connected with the second counter magnetomotive coil in parallel, and the second coil is connected with the first counter magnetomotive coil in parallel.

(10) The permanent magnet actuator is characterized in that: each of the first coil, the second coil, the first counter magnetomotive coil and the second counter magnetomotive coil is independently connected with the control unit.

In accordance with the permanent magnet actuator according to one embodiment of the present disclosure, it is possible to operate with a small amount of the current.

In accordance with the permanent magnet actuator according to another embodiment of the present disclosure, it is possible to reduce the capacitance of the capacitor in constituting the recloser In accordance with the permanent magnet actuator according to another embodiment of the present disclosure, it is possible to decrease the size of the recloser and reduce the costs for manufacturing.

In accordance with the permanent magnet actuator according to another embodiment of the present disclosure, it allows the permanent magnet actuator to be manufactured in a smaller size by reducing the size of the coils.

In accordance with the permanent magnet actuator according to another embodiment of the present disclosure, it is possible to be used in the recloser of a medium-voltage distribution lines by increasing the stroke.

The invention claimed is:

1. A permanent magnet actuator comprising:

a stator iron core having a first wall and a second wall which faces the first wall to define a space therein;

a movable element which is positioned in the space to reciprocate between the first wall and the second wall along a moving axis connecting the first wall and the second wall;

a first magnetomotive force supplying body configured to provide a first forward magnetomotive force for moving the movable element to the first wall;

a second magnetomotive force supplying body configured to provide a second forward magnetomotive force for moving the movable element to the second wall;

a permanent magnet which is disposed between the first magnetomotive force supplying body and the second magnetomotive force supplying body to provide a coercive force to the movable element for maintaining a state thereof; and a driving circuit which comprises a control unit configured to control a voltage or a current supplied to the first magnetomotive force supplying body and the second magnetomotive force supplying body;

wherein at least one of the first magnetomotive force supplying body and the second magnetomotive force supplying body further provides a reverse magnetomotive force for moving the movable element in a direction opposite to a direction in which the first forward or the second forward magnetomotive force is applied.

2. The permanent magnet actuator according to claim 1, wherein the first magnetomotive force supplying body comprises a first coil, the second magnetomotive force supplying body comprises a second coil, each of the first coil and the second coil is independently connected with the control unit in the driving circuit, and the control unit is configured to control a direction of a current supplied to at least one of the first coil and the second coil to be a forward direction or a reverse direction, so as to selectively generate a first wall-direction magnetomotive force and a second wall-direction magnetomotive force in at least one of the first magnetomotive force supplying body and the second magnetomotive force supplying body.

3. The permanent magnet actuator according to claim 1, wherein the first magnetomotive force supplying body comprises a first coil, the second magnetomotive force supplying body comprises a second coil, the first coil and the second coil are connected with each other in series in the driving circuit, and the control unit is configured to control a direction of a current supplied to the first coil and the second coil to be a forward direction from the first coil to the second coil or a reverse direction opposite thereto from the second coil to the first coil, so as to generate a first wall-direction magnetomotive force or a second wall-direction magnetomotive force in both of the first magnetomotive force supplying body and the second magnetomotive force supplying body.

4. The permanent magnet actuator according to claim 3, wherein the driving circuit comprises: a first rectifying device which is connected from a branch point between the first coil and the second coil to a center tap of the first coil or from a branch point of the first coil on a side opposite to the second coil to the center tap of the first coil to block a forward current and bypass a reverse current; and a second rectifying device which is connected from a branch point between the first coil and the second coil to a center tap of the second coil or from a branch point of the second coil on a side opposite to the first coil to the center tap of the second coil to block the reverse current and bypass the forward current, such that a magnitude of the magnetomotive force generated in the first magnetomotive force supplying body during applying the forward current is larger than that of the magnetomotive force generated in the first magnetomotive force supplying body during applying the reverse current, and a magnitude of the magnetomotive force generated in the second magnetomotive force supplying body during applying the reverse current is larger than that of the magnetomotive force generated in the second magnetomotive force supplying body during applying the forward current.

5. The permanent magnet actuator according to claim 4, wherein, in the driving circuit, any one of the first rectifying device and the second rectifying device is connected so as to bypass all the current, such that the magnetomotive force is generated only in the first magnetomotive force supplying body during applying the forward current, or the magnetomotive force is generated only in the second magnetomotive force supplying body during applying the reverse current.

6. The permanent magnet actuator according to claim 3, wherein the driving circuit comprises: a first rectifying device which is connected from a branch point between the first coil and the second coil to a center tap of the first coil or from a branch point of the first coil on a side opposite to the second coil to the center tap of the first coil to block the reverse current and bypass the forward current; and a second rectifying device which is connected from a branch point between the first coil and the second coil to a center tap of the second coil or from a branch point of the second coil on a side opposite to the first coil to the center tap of the second coil to block the forward current and bypass the reverse current, such that a magnitude of the magnetomotive force generated in the first magnetomotive force supplying body during applying the reverse current is larger than that of the magnetomotive force generated in the first magnetomotive force supplying body during applying the forward current, and a magnitude of the magnetomotive force generated in the second magnetomotive force supplying body during applying the forward current is larger than that of the magnetomotive force generated in the second magnetomotive force supplying body during applying the reverse current.

7. The permanent magnet actuator according to claim 6, wherein in the driving circuit, any one of the first rectifying device and the second rectifying device is connected so as to bypass all the current, such that the magnetomotive force is generated only in the second magnetomotive force supplying body during applying the forward current, or the magnetomotive force is generated only in the first magnetomotive force supplying body during applying the reverse current.

8. The permanent magnet actuator according to claim 1, wherein the first magnetomotive force supplying body comprises a first coil, the second magnetomotive force supplying body comprises a second coil, and further comprising: at least one of a first counter magnetomotive coil which is included in the first magnetomotive force supplying body together with the first coil to generate a magnetomotive force of a direction opposite to the first coil, and a second counter magnetomotive coil which is included in the second magnetomotive force supplying body together with the second coil to generate a magnetomotive force of a direction opposite to the second coil.

9. The permanent magnet actuator according to claim 8, wherein, in the driving circuit, the first coil is connected with the second counter magnetomotive coil in series, and the second coil is connected with the first counter magnetomotive coil in series.

10. The permanent magnet actuator according to claim 8, wherein, in the driving circuit, the first coil is connected with the second counter magnetomotive coil in parallel, and the second coil is connected with the first counter magnetomotive coil in parallel.

11. The permanent magnet actuator according to claim 8, wherein each of the first coil, the second coil, the first counter magnetomotive coil and the second counter magnetomotive coil is independently connected with the control unit.

* * * * *